US006883447B1

(12) United States Patent
Kitazawa

(10) Patent No.: US 6,883,447 B1
(45) Date of Patent: Apr. 26, 2005

(54) SEWING MACHINE WITH NEEDLE THREAD CASSETTE AND NEEDLE THREAD CASSETTE

(75) Inventor: Hiroshi Kitazawa, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 113 days.

(21) Appl. No.: 10/451,683

(22) PCT Filed: Dec. 25, 2001

(86) PCT No.: PCT/JP01/11332

§ 371 (c)(1),
(2), (4) Date: Jun. 25, 2003

(87) PCT Pub. No.: WO02/053821

PCT Pub. Date: Jul. 11, 2002

(30) Foreign Application Priority Data

Dec. 27, 2000 (JP) ..... 2000-396964

(51) Int. Cl.[7] ..... D05B 59/00
(52) U.S. Cl. ..... 112/302
(58) Field of Search ..... 112/302, 254, 112/241, 279, 186; 242/118, 134–140, 170, 171, 593, 159

(56) References Cited

U.S. PATENT DOCUMENTS 3,269,671 A * 8/1966 Cole, Jr. ..... 242/326.3
3,749,039 A 7/1973 Fritts
4,100,867 A 7/1978 Bass et al.
4,183,313 A 1/1980 Odermann et al.
5,063,866 A * 11/1991 Jimenez et al. ..... 112/302
5,441,003 A 8/1995 Hashiride
6,467,419 B1 * 10/2002 Hori ..... 112/302
6,513,742 B1 * 2/2003 Watson ..... 242/171
6,729,252 B1 * 5/2004 Wada et al. ..... 112/278

FOREIGN PATENT DOCUMENTS

| | | |
|---|---|---|
| JP | A 55-81693 | 6/1980 |
| JP | A 57-42350 | 3/1982 |
| JP | B2 63-30037 | 6/1988 |
| JP | A 5-277274 | 10/1993 |
| JP | A 7-24173 | 1/1995 |
| JP | B2 7-38912 | 5/1995 |
| JP | B2 2650262 | 5/1997 |
| JP | A 10-151287 | 6/1998 |

* cited by examiner

*Primary Examiner*—Ismael Izaguirre
(74) *Attorney, Agent, or Firm*—Oliff & Berridge, PLC

(57) ABSTRACT

A sewing machine with a needle thread cassette, wherein a cassette mount (3) is reduced in size. The cassette mount (3) including a thread take-up lever travel region is formed in the form of a vertical groove in the arm head of the sewing machine. A needle thread cassette (2) having a thread bobbin (62) vertically received therein is removably mounted on the cassette mount (3) vertically from above. With a thread take-up lever (25) stopped in a position corresponding to a needle top stop position, the needle thread cassette (2) is mounted on the cassette mount (3), whereby the thread is engaged with the thread guard of the thread take-up lever (25) and a thread tension regulator (9).

18 Claims, 35 Drawing Sheets

SEWING MACHINE WITH NEEDLE THREAD CASSETTE AND NEEDLE THREAD CASSETTE

TECHNICAL FIELD

The present invention relates to a sewing machine with a needle thread cassette, which is removably mounted on a cassette mount of an arm, and to a needle thread cassette.

BACKGROUND ART

In an ordinary sewing machine, there are arranged a thread take-up lever mechanism to be driven in an arm by a spindle, a thread take-up lever mechanism and a needle bar drive mechanism. A thread take-up lever is partially protruded from a vertical slit in an arm head and is reciprocally driven up and down. The arm is provided with a thread bobbin mount on its upper end side, with a thread tension regulator and a thread tension spring on its front face side and with a tension dial for a thread tension regulator near the thread tension regulator. A needle bar protrudes downward of the arm head, and a needle is attached to the lower end portion of the needle bar. A presser foot for pressing a cloth to be sewn and a presser bar for supporting the presser foot can be switched between a bottom position, at which the cloth is pressed by a lifting lever, and an upward retracted position.

In case the sewing is interrupted to exchange the thread bobbin, the presser foot is at the retracted position, and the thread tension regulator is in a released state. In this state, the thread bobbin is exchanged, and the needle thread fed out from the thread bobbin is guided through a plurality of thread guides to the thread tension regulator. The thread is engaged between a pair of thread tension discs in the released state, with a thread tension spring and further with a thread guard of the thread take-up lever. After this, the needle eye of a needle is threaded with the end portion of the needle thread. When the thread bobbin of the needle thread is to be thus exchanged, the thread is engaged with the thread tension regulator, the thread tension spring and the thread guard of the thread take-up lever and is introduced into the needle eye.

U.S. Pat. No. 3,749,039 discloses the technique, in which the threading is simplified by mounting the needle thread cassette removably on the arm. At a substantially transverse center portion of the arm of the sewing machine, there is disposed the cassette mount, in which the needle thread cassette can be removably mounted from above. This cassette mount is formed on the right side of a thread take-up lever travel space, in which the thread take-up lever of the thread take-up lever mechanism can travel reciprocally up and down, and the leading end portion of the thread take-up lever penetrates into the left end portion of the cassette mount and travels reciprocally up and down.

This needle thread cassette disclosed in U.S. Pat. No. 3,749,039 includes a cassette case having a generally trapezoidal shape, as viewed in a front elevation, and this cassette case is constructed of a case body and an openable cover. The thread bobbin is so housed in its housing portion at the upper portion in the cassette case with its axis being horizontal, and its needle thread is fed out substantially horizontally rightward by a predetermined length. The cassette case is provided in the lower portion of its center portion with a first notch for penetrating the thread tension regulator and in the lower portion of its left end portion with a second notch for introducing the thread take-up lever.

There are provided five thread guide portions for guiding the needle thread fed out from the thread bobbin. The first thread guide portion is disposed in the upper portion of the right end of the cassette; the second and third thread guide portions are disposed at positions interposing the first notch; and the fourth and fifth guide portions are disposed at positions interposing the second notch. The first thread guide portion is provided with a first resistance applying portion for applying the resistance to the needle thread, in the state where the needle thread cassette is not mounted in the cassette mount, and for releasing the resistance after the cassette was mounted. The fifth thread guide portion is provided with a second resistance applying portion for applying the resistance to the needle thread, in the state where the cassette is not mounted, and for releasing the resistance after the cassette was mounted. This second resistance applying portion applies a higher resistance than that of the first resistance applying portion.

At the left end portion of the cassette mount disposed in the arm, there is provided a thread guide member for guiding the needle thread to the thread guard of the thread take-up lever when the needle thread cassette is to be mounted. This thread guide member is made by forming a pair of left and right arm plates and a web integrally. On the rear ends of the paired arm plates, there are formed guide faces for guiding the needle thread, and notches (or cut-off portions) corresponding to the thread guard of the thread take-up lever are formed in those arm plates. At the needle thread cassette and the cassette mount, moreover, there is provided a mechanism for bringing the paired thread tension discs of the thread tension regulator into an open state, when the needle thread cassette is mounted, and for closing the paired thread tension discs after the needle thread cassette was completely mounted.

In case the needle thread cassette is to be mounted in the cassette mount, the spindle is manually turned at first to move the thread take-up lever to the lowermost position. Next, as the needle thread cassette is mounted from above in the cassette mount, the needle thread moves down while being guided by the thread guide members, and the needle thread between the second and third thread guide portions is automatically engaged with the thread tension regulator and the thread tension spring. The needle thread between the fourth and fifth thread guide portions is guided by the guide faces of the thread guide members and is automatically engaged with the thread guard of the thread take-up lever. When the needle thread cassette is completely mounted, the first and second resistance applying portions come into the released state so that the needle thread is fed out from the thread bobbin during the subsequent sewing operation.

In JP-A-55-81693, on the other hand, there is proposed a cassette type threading device for a sewing machine. This cassette type threading device is provided with a thread take-up lever travel region of an arm, a cassette mount disposed on the right side of the region, and a cover member for opening/closing the cassette mount. The needle thread cassette is removably mounted in that cover member. A thread tension regulator and a thread take-up spring protrude into the cassette mount, and a thread take-up lever travel space is formed in the left end portion of the cassette mount.

The needle thread cassette is provided with a bobbin housing portion and a pair of leg portions, and extends the needle thread, as fed out from the center of the bobbin, between the paired leg portions to form a free span. The cover member is opened by turning it 90 degrees forward and is closed after it is set with the needle thread cassette. At the action closing the cover member with the thread take-up lever being at the lowermost position, the free span of the needle thread cassette is automatically engaged with the thread tension regulator and the thread take-up spring. When the thread take-up lever is then raised, the needle thread is automatically engaged with the thread take-up portion of the thread take-up lever. Here, with the cover member being closed, the axis of the bobbin is directed in the horizontal direction and in the longitudinal direction.

In JP-A-7-24173, on the other hand, there is disclosed a needle thread cartridge, which is removably mounted on a cartridge mounting portion on the left side face of the arm head of a sewing machine. In the needle thread cartridge, a bobbin (or a thread bobbin) is retained in a case, a slit, into which the thread guard of the thread take-up lever penetrates, is formed in the wall portion of the case. In the case, there is provided a cartridge lever for supporting the needle thread to be engaged with the thread guard of the thread take-up lever. The cartridge is mounted in a cartridge mount irrespective of the vertical position of the thread guard of the thread take-up lever so that the thread can be engaged with the thread guard of the thread take-up lever.

DISCLOSURE OF THE INVENTION

The aforementioned needle thread cassette disclosed in U.S. Pat. No. 3,749,039 is mounted in the cassette mount which is formed at the front face portion of the generally transverse center portion of the arm of the sewing machine. In this needle thread cassette, the thread bobbin is housed in a horizontal posture in the needle thread cassette, and the needle thread is fed out rightward from the thread bobbin by a predetermined length and guided through the first to fifth thread guide portions to the outside. Therefore, the transverse width of the needle thread cassette is remarkably enlarged to enlarge the size of the needle thread cassette. Likewise, the cassette mount to be formed in the arm of the sewing machine is also enlarged to raise many restrictions on the design of the arm.

In the state where the thread guard of the thread take-up lever is retained at the lowermost position (or the thread loosening position) by turning the spindle manually, moreover, the needle thread cassette is mounted in the cassette mount. In the state where the needle thread cassette is mounted in the cassette mount, the first and second resistance applying portions are released. When the thread take-up lever moves to the uppermost position (or the thread tightening position) at the sewing starting time, therefore, the needle thread is not always fed out from the thread bobbin, and the needle thread in the needle eye may be pulled to come out of the eye.

In case the sewing machine is to be interrupted, it normally stops with its needle bar being at the uppermost position. At this time, the thread take-up lever is also at a position in the thread tightening course near the uppermost position. In the aforementioned sewing machine disclosed in U.S. Pat. No. 3,749,039, when the needle thread cassette is to be mounted, the thread take-up lever has to be switched to the lowermost position by the manual operation, but this operation is troublesome.

In the portion of the arm of the sewing machine near the arm head, there are arranged the needle bar crank connected to the spindle and the thread take-up lever crank, and a thread take-up lever travel space, in which the thread take-up lever reciprocally travels, is formed near the left side of them. These cranks have large turning radii and take wide spaces.

In the aforementioned sewing machine disclosed in U.S. Pat. No. 3,749,039, the cassette mount is so formed between the thread take-up lever travel space and the right side space that it may not interfere with the aforementioned cranks. Therefore, the cassette mount bulges forward (to this side) so that the arm is enlarged in the longitudinal width and in the size.

The present invention contemplates to provide a sewing machine with a needle thread cassette, which can reduce the sizes of the needle thread cassette and the cassette mount, and is excellent in operability and a needle thread cassette for the sewing machine.

According to the invention, there is provided a sewing machine with a needle thread cassette, in which a needle thread cassette housing a thread bobbin is removably mounted in an arm. The sewing machine can be constructed: by comprising a cassette mount disposed near a thread take-up lever travel region, in which a thread guard of a thread take-up lever reciprocally travels, for removably mounting said needle thread cassette; such that said needle thread cassette includes a cassette case, and a thread bobbin retaining portion for retaining a thread bobbin disposed in said cassette case; and such that said needle thread cassette is mounted in said cassette mount such that at least one of the axial direction of the thread bobbin retained in said thread bobbin retaining portion and the direction to feed out the thread from said thread bobbin is made generally parallel to the reciprocal traveling direction of the thread guard of the thread take-up lever.

The sewing machine thus constructed with the needle thread cassette is enabled to reduce the sizes of the needle thread cassette and the cassette mount by reducing the width in the transverse direction of the needle thread cassette, i.e., in the direction to intersect the reciprocally traveling direction of the thread guard of the thread take-up lever. Generally speaking, the space for installing the sewing machine is more seriously influenced by the space extending in the direction to intersect the reciprocal travel direction of the sewing needle, that is, in the direction to intersect the reciprocal travel direction of the thread guard of the thread take-up lever than the space extending in the direction for the sewing needle to pierce into the cloth to be sewn. Therefore, the needle thread cassette and the cassette mount, which are constructed to reduce the width in the direction to intersect the reciprocal travel direction of the thread guard of the thread take-up lever, can highly contribute to the size reduction of the sewing machine.

On the other hand, the cassette mount is disposed near the thread take-up lever travel region, in which the thread guard of the thread take-up lever travels reciprocally, but is small-sized by returning the transverse width of the needle thread cassette. Therefore, the cassette mount can be formed at the portion on the left side of the arm from the thread take-up lever travel region, that is, at the portion corresponding to the leading end of the arm.

In the aforementioned construction, for example, said cassette mount can be formed to mount said needle thread cassette removably from above, and there can also be formed a grooved guide portion for guiding the needle thread cassette linearly when said needle thread cassette is mounted and removed.

With this construction, the needle thread cassette may be inserted, when mounted, from above into the cassette mount and moved linearly downward, so that the needle thread cassette can be mounted by the simple operation.

When the needle thread cassette is to be removed, on the other hand, it may be linearly moved upward, so that the needle thread cassette can also be removed by the simple operation.

According to the invention, there is also provided a sewing machine with a needle thread cassette, in which a needle thread cassette housing a thread bobbin is removably mounted in an arm. The sewing machine can also be constructed: by comprising: a cassette mount disposed on the front face of the leading end portion of said arm for removably mounting said needle thread cassette; a thread take-up lever travel region disposed in said arm near said cassette mount and closer to the portion of the base side, for allowing the thread guard of the thread take-up lever to reciprocally travel therein; and a thread tension regulator disposed to protrude at the lower end side of said cassette mount; such that said needle thread cassette includes a cassette case; and such that said cassette case includes: a thread bobbin retaining portion for retaining said thread bobbin with a vertical axis; a thread exit for feeding the thread fed out from said thread bobbin, to the outside of said cassette case; a thread passage for guiding the thread fed out from said thread bobbin, to said thread exit; a slit for protruding the thread guard of the thread take-up lever into the cassette case; and a notch for protruding the thread tension regulator into the cassette case.

In the sewing machine thus constructed with the needle thread cassette, the needle thread cassette includes the thread bobbin retaining portion for retaining the thread bobbin with the axis being vertical. Therefore, the needle thread cassette and the cassette mount can be small-sized by reducing the transverse width of the needle thread cassette.

In the arm, moreover, the thread take-up lever travel region, in which the thread guard of the thread take-up lever reciprocally travels, is formed on the right end side of the cassette mount, that is, on the side closer to the base. Therefore, the needle bar crank and the thread take-up lever crank having the large turning radii in the arm are arranged on the right side of the leading end of the arm, that is, on the side closer to the base. By disposing the cassette mount on the front face of the leading end of said arm, therefore, the cassette mount can be formed on the left side of the thread take-up lever travel region, that is, on the leading end side of the arm closer to the position, at which the needle bar crank and the thread take-up lever crank are arranged in the arm, namely, at the portion having no interference with them.

In the arm, therefore, the cassette mount and the needle thread cassette to be mounted in the former can be arranged on the front side (or this side) of the arm, that is, with no protrusion to the control side of the user. Even with the needle thread cassette, therefore, the sewing machine can be constructed without being enlarged in size.

Moreover, the thread take-up lever is retained at the position on the thread tightening side, and the thread tension discs of the thread tension regulator are brought into the open state, so that the needle thread can be engaged with the thread guard of the thread take-up lever and the thread tension discs while mounting the needle thread cassette. In the case of this construction, in accordance with the operation to mount the needle thread cassette, the needle thread can be easily engaged with the thread guard of the thread take-up lever and the thread tension discs so that the operability can be improved.

For example, moreover, said thread tension regulator may be constructed to include thread tension discs and a thread tension spring, and the needle thread of the needle thread cassette can also be engaged with the thread guard of the thread take-up lever, the thread tension discs and the thread tension spring in association with the action to mount said needle thread cassette in the cassette mount.

In the case of this construction, the needle thread of the needle thread cassette is engaged with the thread guard of the thread take-up lever, the thread tension discs and the thread tension spring in association with the mounting action to mount the needle thread cassette in the cassette mount. Therefore, the threading works is very simplified so that the needle thread can be efficiently exchanged by exchanging the needle thread cassette.

For example, moreover, said thread passage can be constructed to feed out the needle thread upward from the thread bobbin of said thread bobbin retaining portion and then to guide the fed needle thread to the thread exit of the cassette case, such that said needle thread cassette is provided with a first clamp portion for applying a passing resistance to the needle thread upstream of the thread passage, and a second clamp portion for applying a passing resistance to the needle thread near the thread exit of the cassette case, and such that said first clamp portion applies the passing resistance to the needle thread to tense the needle thread between itself and the thread tension regulator no matter whether the needle thread cassette is mounted or not in the cassette mount.

In the case of this construction, the thread passage is formed to guide the needle thread, as fed out upward from the thread bobbin of the thread bobbin retaining portion, into the thread exit of the cassette case. If necessary, therefore, the needle thread can be guided along the side portion or the lower end portion in the cassette case. The first and second clamp portions are provided to apply the passing resistances to the needle thread so that the needle thread is not suddenly fed out while the needle thread cassette is being handled. When the needle thread is engaged with the thread guard of the thread take-up lever and the thread tension regulator while the needle thread cassette is being mounted in the cassette mount, the needle thread can also be fed out without fail from the thread bobbin.

In this case, however, it is desired that the second clamp portion is set to apply a higher passing resistance than that of the first clamp portion, and that the second clamp portion is released after the needle thread is completely mounted.

Moreover, the first clamp portion applies the passing resistance to the needle thread thereby to tense the needle thread between itself and the thread tension regulator no matter whether the needle thread cassette is mounted in the cassette mount or not. Therefore, the needle thread can be prevented from being interlaced or broken by its twist.

For example, moreover, before said needle thread cassette is completely mounted in the cassette mount, the passing resistance applied at the second clamp portion can be made higher than the passing resistance applied at the first clamp portion.

With this construction, when the needle thread cassette is mounted in the cassette mount, the needle thread can be fed out without fail from the thread bobbin so that the thread guard of the thread take-up lever and the thread tension regulator are properly threaded.

For example, moreover, the cassette case of said needle thread cassette can be provided with color discriminating means for discriminating the thread color of the thread bobbin housed in the cassette case.

In the case of this construction, when the needle thread is exchanged by exchanging the needle thread cassette, the thread color of the thread bobbin can be discriminated through the color discriminating means disposed in the cassette case. Therefore, the color of the needle thread can be simply known to improve the operability.

For example, moreover, a recess deeper on a radially inner side than the outer circumference of said thread bobbin can be formed in such a portion of the thread bobbin retaining portion for retaining said thread bobbin as corresponds to the lower end portion of said thread bobbin.

In the case of this construction, when the thread bobbin is removed from the thread bobbin retaining portion of the needle thread cassette, the thread bobbin can be simply removed with the finger in said recess so that the operability can be improved.

For example, moreover, the cassette case of said needle thread cassette can be provided on its outer face with a thread holder capable of temporarily retaining the end side portion of the thread extending from the needle thread cassette to the outside of the needle thread cassette.

With this construction, when the needle thread cassette is removed from the cassette mount, the needle thread extending to the outside of the cassette can be temporarily retained at its end side portion on the thread holder by winding it on the outer face of the cassette case.

According to the invention, moreover, there is provided a needle thread cassette to be removably mounted on the arm of a sewing machine. The needle thread cassette can also be constructed: by comprising: a cassette case; a thread bobbin; a thread bobbin retaining portion disposed in said cassette case for retaining said thread bobbin in the cassette case; and a thread passage disposed in said cassette case for guiding the thread fed out from said thread bobbin, to said thread exit; and such that said thread bobbin or said thread passage is so arranged that when the needle thread cassette is mounted in the sewing machine, at least one of the axial direction of the thread bobbin retained in said thread bobbin retaining portion and the direction to feed out the thread from said thread bobbin is made generally parallel to the reciprocal traveling direction of the thread guard of the thread take-up lever.

The needle thread cassette thus constructed can also be constructed to have a small width in the transverse direction, that is, in the direction to intersect the reciprocal travel direction of the thread guard of the thread take-up lever. Therefore, this construction can highly contribute not only to the size reduction of the needle thread cassette itself but also to the size reduction of the sewing machine, in which the needle thread cassette is mounted.

Moreover, the needle thread cassette can also be constructed to have such one of the aforementioned features for the sewing machine with the needle thread cassette according to the invention as belongs to the needle thread cassette.

In case the needle thread cassette is constructed to have such feature, it is possible to improve the easily handling of the needle thread cassette itself and the operability at the time when the needle thread cassette is mounted in the sewing machine.

BRIEF DESCRIPTION OF THE DRAWINGS

FIG. 5 is a front elevation of a needle bar lifting mechanism, an automatic threading mechanism and so on.

FIG. 10 is a longitudinally sectional side elevation of a threading slider actuating mechanism, the needle thread cassette and so on.

FIG. 36 is a side elevation of the needle thread cassette and shows a thread holding portion and so on.

FIG. 37 is a front elevation of a foot lifting lever, a thread tension regulator, an interlocking mechanism and so on.

FIG. 38 is a side elevation of the foot lifting lever, the thread tension regulator, the interlocking mechanism and so on.

FIG. 39 is a top plan view of the foot lifting lever, the thread tension regulator, the interlocking mechanism and so on.

BEST MODE FOR CARRYING OUT THE INVENTION

Figure 1:
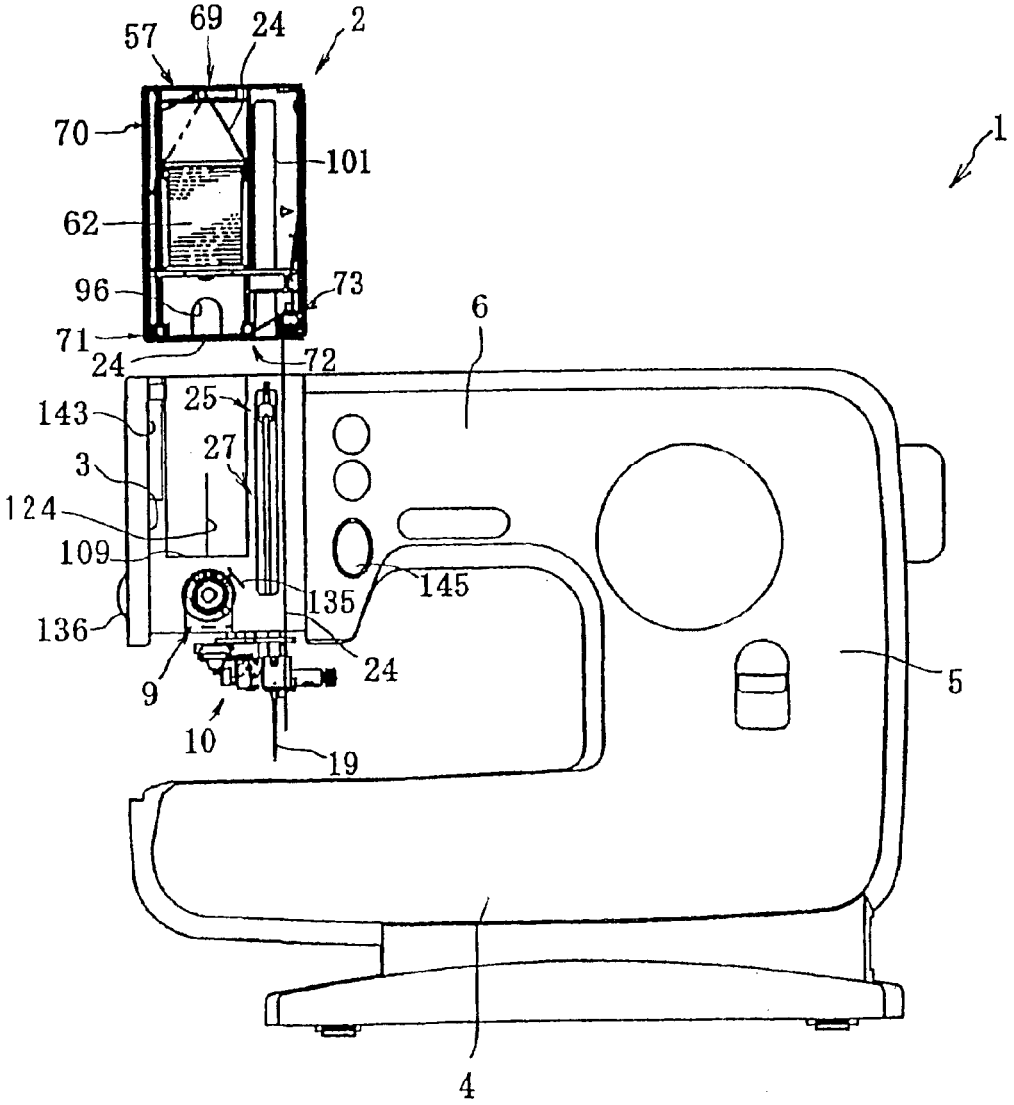
FIG. 1 is a front elevation of an electronic control sewing machine of an embodiment of the invention and its needle thread cassette.

An embodiment of the invention will be described with reference to the accompanying drawings. This electronic control sewing machine is constructed such that an needle thread cassette housing a thread bobbin can be mounted in a cassette mounting portion of an arm head, and such that an needle thread is engaged with the thread guard of a thread take-up lever and a thread tension regulator and is introduced into the eye of a needle in association with the mounting action to mounting an needle thread cassette 2.

The description will be made at first on the basic structure of the sewing machine 1 and on a threading mechanism 10, and then on the needle thread cassette 2, a cassette mount 3, a thread take-up lever 8, a transmission mechanism 115 for the threading operation, and an interlocking mechanism 134 for a thread tension regulator 9 sequentially in the recited order. Here, the following description is made by assuming that the front/back and left/right are taken from an operator of the sewing machine.

Figure 2:
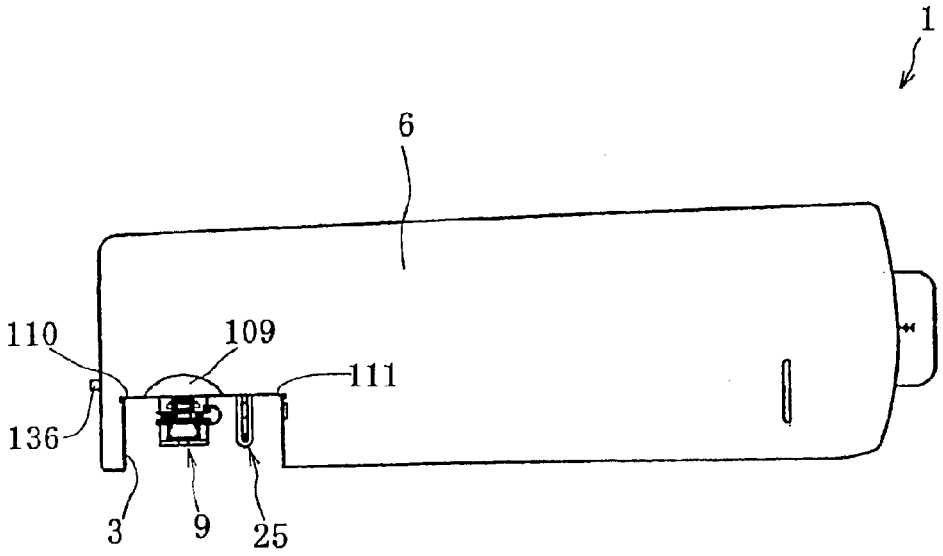
FIG. 2 is a top plan view of the sewing machine in the state where the needle thread cassette is removed.
Figure 3:
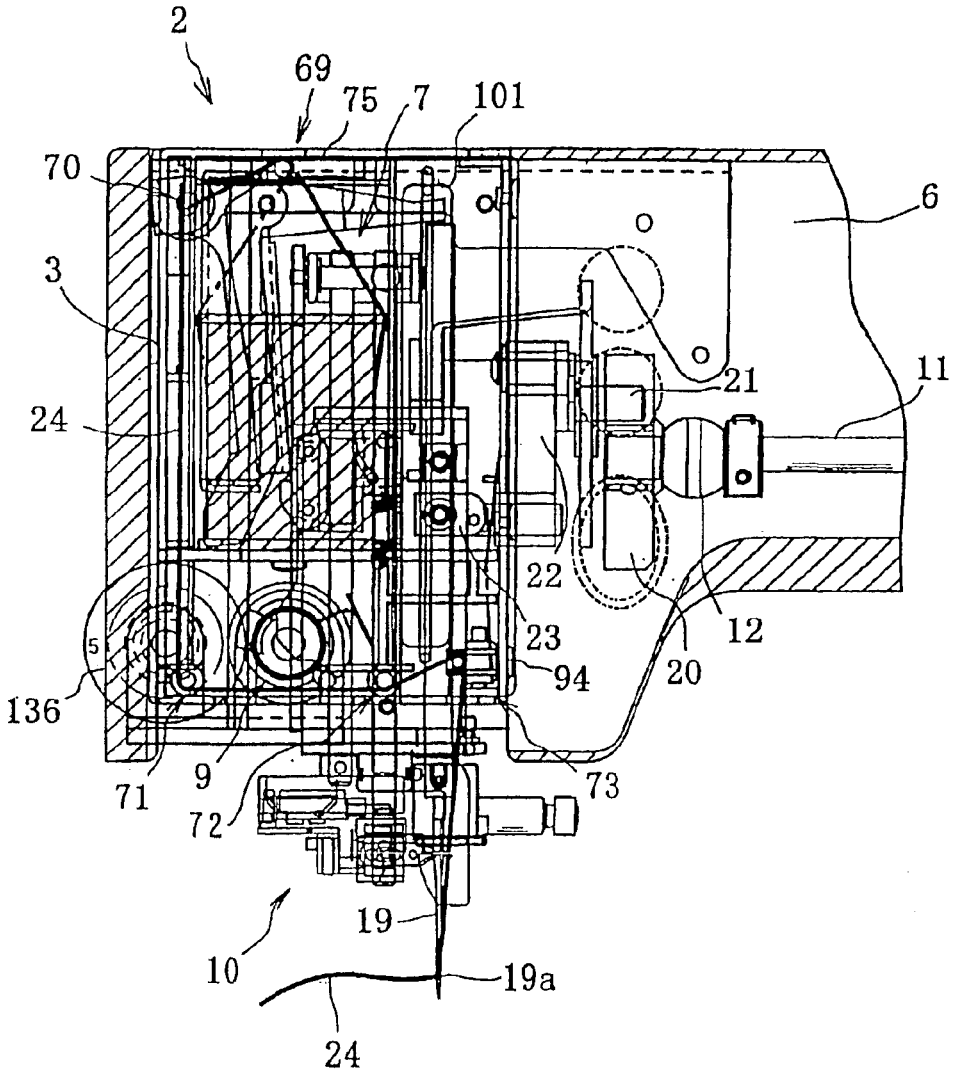
FIG. 3 is a longitudinal section showing the internal structure near a cassette mounting portion.

As shown in FIG. 1 to FIG. 3, this electronic control sewing machine 1 includes a bed 4, a column 5 erected from the right end portion of the bed 4, and an arm 6 extending leftward from the upper end of the column 5. The arm 6 is provided with a needle bar lifting mechanism 7, the cassette mount 3, the thread take-up lever mechanism 8, the thread tension regulator 9 and the automatic threading mechanism 10. Here, the cassette mount 3 is provided in the head (or arm head) of the arm 6. In this arm 6, a spindle 11 is rotatably supported through a pair of bearings 12 and is rotationally driven by the driving force of the not-shown sewing machine motor.

Next, the needle bar lifting mechanism 7 will be briefly described because it has a general structure. At the arm head of the arm 6, as shown in FIG. 1 and FIG. 3 to FIG. 8, there is upright arranged a needle bar bed frame 13, which is provided with a rear wall portion 14 and a left wall portion 15. A lower support portion 14*a* and an upper support portion 14*b* extending forward are formed integrally with the lower end and the upper end of the rear wall portion 14, respectively. At the upper end portion of the left wall portion 15, there is formed a hinged arm portion 15*a*, which extends upward of the upper support portion 14*b*. A needle bar 18 is so inserted into the upper support portion 14*b* and the lower support portion 14 as to move up and down.

On the upper end portion of the hinged support portion 15*a*, there is fixed a transverse pin member 16*a*, to which a hinged member 16 having a generally, as viewed in a top plan, C-shape opened on the front face is fixedly connected. The hinged member 16 is so supported on the sewing machine frame through a longitudinal and horizontal support pin 17 as to rock so that the needle bar bed frame 13 can rock transversely (or in a needle deflecting direction) on the support pin 17. Here, the mechanism for rocking/driving the needle through the needle bar bed frame 13 by the stepping motor is omitted in its description because it is a general one.

The needle bar 18 is vertically movably supported on the upper support portion 14*b* and the lower support portion 14*a*, and carries a needle 19 removably at its lower end.

As shown in FIG. 3 and FIG. 11 to FIG. 13, the spindle 11 is provided on its left end side with a thread take-up lever crank 20 of the thread take-up lever mechanism 8, to which a needle bar crank 22 is turnably connected through a crank pin 21. On the substantially intermediate portion of the needle bar 18, there is fixed a needle bar connecting bracket 23, to which the needle bar crank 22 is connected. At the sewing time, the spindle 11 is rotationally driven by the machine motor so that the needle bar 18 is vertically reciprocated driven by the needle bar crank 22.

As shown in FIG. 11 to FIG. 15 and FIG. 17, the arm 6 is provided with the thread take-up lever mechanism 8, which is equipped with a thread take-up lever 25 for taking up an needle thread 24 in synchronism with the vertical travel of the needle 19.

At the leading end portion of the thread take-up lever 25, there is formed a thread guard 26, which can thread from above. Throughout the height of the right end side portion of the cassette mount 3, there is formed a thread take-up lever travel region 27, in which the thread guard 26 of the thread take-up lever 25 can reciprocate up and down. The thread tension regulator 9 for applying a passing resistance to the needle thread is provided to protrude to the lower portion of the cassette mount 3.

This thread tension regulator 9 can be opened/closed by a foot lifting lever 29 for moving a presser foot 28 up and down, and is opened/closed, too, when the needle thread cassette 2 is mounted, as will be described hereinafter. Here, a generally upright vertical shaft is arranged in the column 5 and is interlocked with and connected to the spindle 11 through a gear mechanism so that its driving force is transmitted to a thread catching hook in the bed 4. As in the general electronic control sewing machine, a processed cloth 30 is sewn by the coactions among the needle 19, the thread catching hook and the cloth feeding mechanism, which is driven by the stepping motor.

Next, the automatic threading mechanism 10 for threading the needle eye 19*a* of the needle 19 with the needle thread 24 will be described with reference to FIG. 5 to FIG. 10, FIG. 14, FIG. 15, FIG. 17 and FIG. 19.

On the upper support portion 14*b* and the lower support portion 14*a* of the needle bar bed frame 13, there are vertically movably supported a threading pin 31 and a slider guide pin 32, which are located on the left side of the needle bar 18. The upper end portion of the threading pin 31 is inserted into the clearance between the bracket 16 and the pin member 16*a*, and a horizontally protruding slide pin 33 is fixed on a substantially intermediate portion of the threading pin 31.

A hook retaining member 34 made of a synthetic resin is fixed at the lower end portion of the threading pin 31, and a first thread guide member 35 (as referred to FIG. 17) having a general C-shape in a side view is rotatably supported at its upper support portion and at its lower support portion by the threading pin 31 corresponding to the upper side and the lower side of the hook retaining member 34. At a vertical connecting wall 36 connecting the upper support portion and the lower support portion of the first thread guide member 35, there is notched a thread guide 36*a* for engaging with the needle thread 24 to guide it.

Figure 9A:
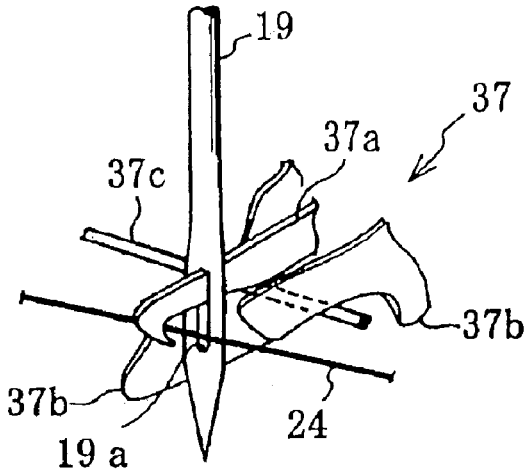
FIG. 9A is a perspective view showing the state immediately before the threading by a threading hook.
Figure 9B:
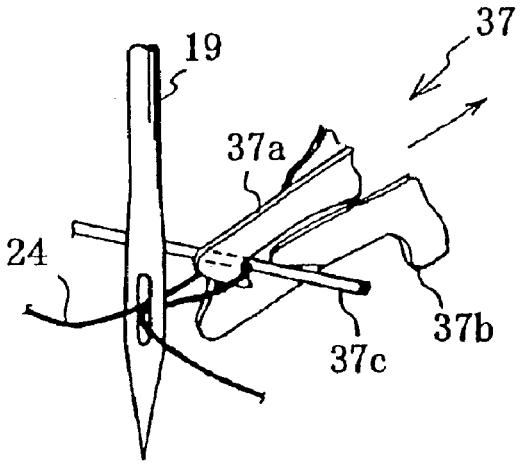
FIG. 9B is a perspective view showing the state immediately after the threading.
Figure 9C:
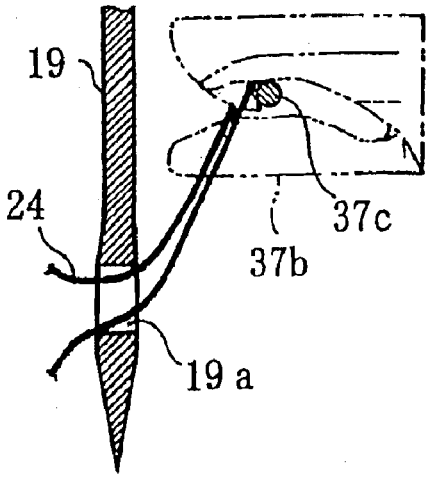
FIG. 9C is a section of an essential portion in the state where the threading hook has risen after the threading.

As shown in FIG. 9A to FIG. 9C, a hook mechanism 37 is fixed on the hook retaining member 34. The hook mechanism 37 is constructed of a threading hook 37*a*, two guide members 37*b* positioned on the two sides of the threading hook 37*a*, and a thread retaining wire 37*c* extending horizontally through those threading hook 37*a* and guide members 37*b*. At the leading end portion of the threading hook 37*a*, there is formed a hook portion, which is inserted at the threading time into the eye 19*a* so that the needle 19 hooks the needle thread 24 which is positioned just ahead the eye 19*a* while being guided by the aforementioned guide member 37*b*.

On the hook retaining member 34, there is integrally fixed a second thread guide member 38, which is bent downward generally near its leading end portion so that the bent portion functions as a thread guide portion 38*a*. This thread guide portion 38*a* is positioned substantially on the opposite side of the hook mechanism 37 with respect to the threading pin 31 and spaced at a predetermined distance. In short, the second thread guide member 38 and the hook mechanism 37 are disposed integrally with the threading pin 31 while retaining a predetermined positional relation.

Here will be described a turning mechanism for turning the threading pin 31 by a predetermined angle.

Around the upper end portions of the threading pin 31 and the slider guide pin 32 on the back side of the needle bar bed frame 13, as shown in FIG. 5 to FIG. 8, FIG. 14, FIG. 15, FIG. 17 and FIG. 19, there is vertically movably fitted a threading slider 40, which is made of a synthetic resin. Specifically, this threading slider 40 is equipped with an upper hinge portion 41, a lower hinge portion 42, an outer circumferential wall portion 43 and a threading slider pawl 44.

The upper hinge portion 41 and the lower hinge portion 42 are extended over the threading pin 31 and the slider guide pin 32. The outer circumferential wall portion 43 is formed to connect those upper hinge portion 41 and the lower hinge portion 42 vertically and to cover about one half of the outer circumference of the aforementioned upper end portion. A threading slider cam portion 43*a* of a helical shape is formed at the outer circumferential wall portion 43. To the left end portions of the upper hinge portion 41 and the lower hinge portion 42, there is connected the threading slider pawl 44, which has a pawl portion 44*a* at a substantially intermediate portion of its left end.

Through the substantially intermediate portion of the threading pin 31 and at a position corresponding to the just upper side of the lower hinge portion 42, there is fixed through the slide pin 33 of a predetermined length, which engages at its deep end portion with the threading slider cam portion 43*a*. A spring receiving pin 45 is fixed through the side of the threading pin 31 lower by a predetermined length than the slide pin 33. A compression coil spring 46 is mounted around the threading pin 31 and between the lower hinge portion 42 and the spring receiving pin 45. Around the slider guide pin 32 and between the lower hinge portion 42 and the lower support portion 14*a* of the needle bar bed frame 13, there is mounted a compression coil spring 47 for biasing the threading slider 40 upward.

Here will be described an offset member 48. As shown in FIG. 4 to FIG. 8, this offset member 48 is so mounted on the threading pin 31 and the slider guide pin 32 as to move vertically on the back side of the threading slider 40 and within a range of about three quarters as long as the height between the upper support portion 14*b* and the lower support portion 14*a* of the needle bar bed frame 13. This offset member 48 is constructed to include an upper support portion 49, a lower support portion 50 and a vertical connecting wall 51 connecting those upper support portion 49 and lower support portion 50. The upper support portion 49 penetrates into the threading pin 31 and the slider guide pin 32, and the lower support portion 50 penetrates only into the threading pin 31.

A threading positioning member 52 is fixed as an engaging member immediately above the needle bar connecting bracket 23 of the needle bar 18, and the right end portion of the upper support portion 49 of the offset member 48 is so constructed that it can abut against the threading positioning member 52 from above. With the right end portion of the upper support portion 49 abutting against the threading positioning member 52, the threading hook takes the same height position as that of the eye 19*a* of the needle 19 (as referred to FIG. 6). At the left end lower portion of the connecting wall 51, there is formed an offset member cam portion 53, which includes a slope portion 53*a* protruding more leftward as it goes more downward, and a flat portion 53*b* extending vertically downward from the lower end of the slope portion 53*a* and protruding more leftward than the pawl portion 44*a* of the threading slider pawl 44.

Figure 5:
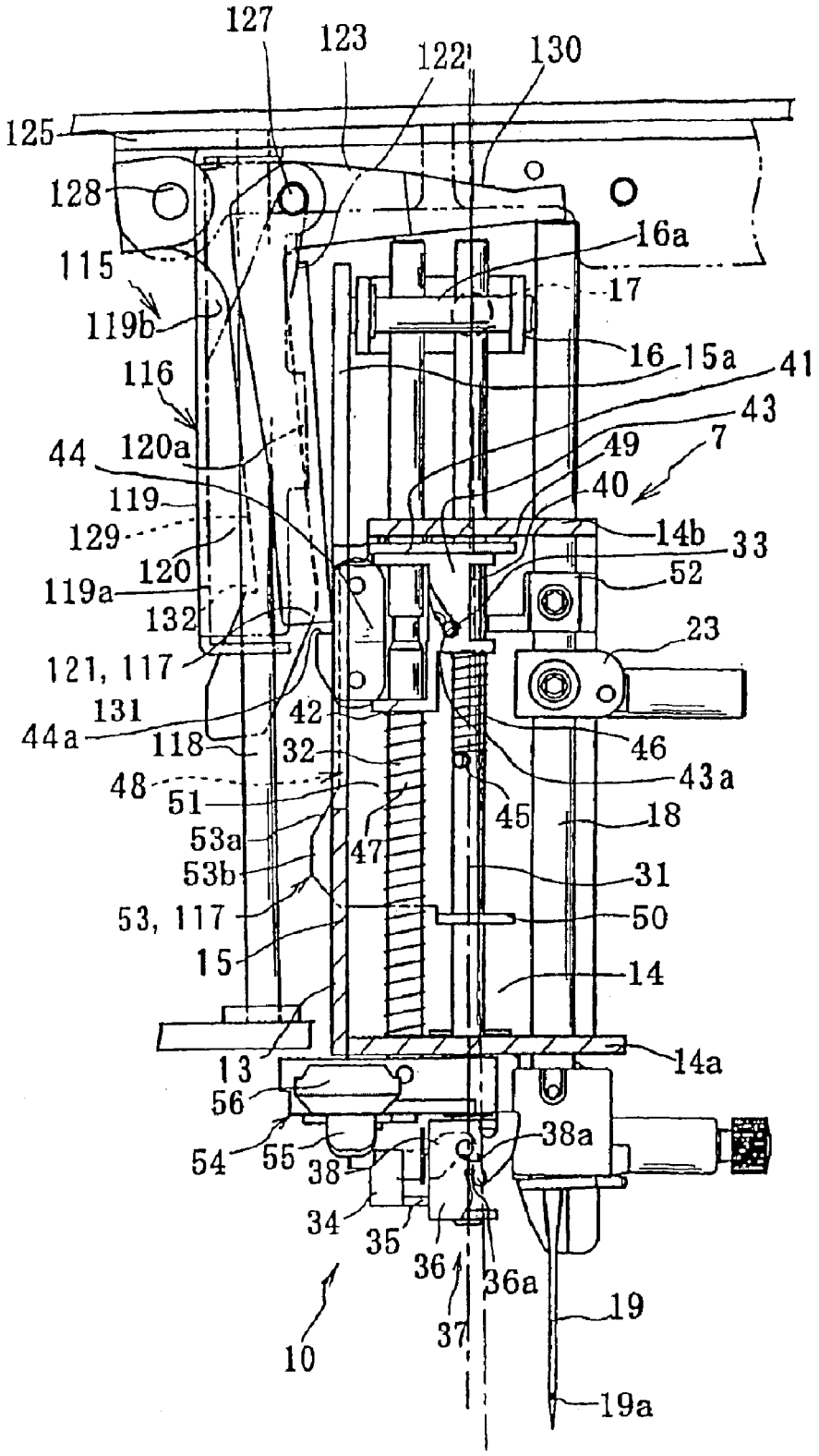

Accordingly as the threading slider 40 is pressed downward from the upper limit position, as shown in FIG. 5, by a later-described needle thread cassette 2 against the biasing force of the compression coil spring 47, the threading pin 31, the slider guide pin 32 and the offset member 48 move down and stop when the upper support portion 49 of the offset member 48 comes into abutment against the threading positioning member 52 (as referred to FIG. 6). At this time, the threading slider 40 moves down relative to the threading pin 31 and the slider guide pin 32 so that the slide pin 33 moves along the threading slider cam portion 43*a* having the helical shape. The threading is effected when the threading pin 31 is turned by a predetermined angle clockwise, as viewed in a top plan view (as referred to FIG. 9A to FIG. 9C).

In this threading operation, the hook mechanism 37 is turned in a direction toward the needle 19 so that the aforementioned threading hook penetrates into the needle eye 19*a*. Simultaneously with this, the second thread guide member 38 is turned clockwise (or in the direction away from the needle 19) in synchronism with the hook mechanism 37. There is further provided a link mechanism 54 for turning the first thread guide member 35, which is turnably supported on the lower end portion of the threading pin 31, in the threading operation in the direction away from the second thread guide member 38. When the threading pin 31 in a standby state before turned for the threading operation, more specifically, the second thread guide member 35 takes a forward posture, and its thread guide portion 38*a* is positioned immediately inside of the thread guide 36*a* of the connecting wall 36.

When the threading pin 31 turns after it went to the lower limit position, the hook mechanism 37 and the second thread guide member 38 integrally rotate clockwise, as viewed in the top plan, and the first thread guide member 35 turns counterclockwise through the link mechanism 54. In short, the first thread guide member 35 moves apart from the second thread guide member 38 and toward the hook mechanism 37. Here, a support plate 55 for clamping the needle thread 24 under a slight pressure and a thread guide disc 56 are also disposed near the link mechanism 54.

Here will be described the needle thread cassette 2.

As shown in FIG. 1, FIG. 10 and FIG. 14 to FIG. 36, the needle thread cassette 2 acting as a movable operation member includes: a cassette case 57 having a shape similar to an elongated box having a small transverse width; a thread bobbin housing portion 57*a* for housing a thread bobbin 62; a thread bobbin retaining portion 58 for retaining the thread bobbin 62 in the thread bobbin housing portion 57*a*; the thread bobbin 62 retained in the thread bobbin retaining portion 58; a thread passage 59 for guiding the needle thread 24, as supplied from the thread bobbin 62, to a thread exit 68; a thread take-up lever travel region 57*b* or *a* region, in which the thread guard 26 of the thread take-up lever 25 of the thread take-up lever mechanism 8 reciprocates up and down; and a thread tension regulator housing portion 57*c* for penetrating the thread tension regulator 9 thereinto. Here, the thread exit 68 is formed in the bottom wall of the cassette case 57 near the right end.

The cassette case 57 is equipped with a cassette body 60 made of a synthetic resin and an openable cover 61, of which the openable cover 61 is operably connected to the right end portion of the cassette body 60. However, the openable cover 61 may also be so constructed that it may be opened/closed by sliding it up and down with respect to the cassette body 60. As thread color discriminating means for discriminating the color of the needle thread 24 of the thread bobbin 62, the openable cover 61 is made of a transparent material so that it may be able to discriminate the thread color of the thread bobbin 62 in the cassette case 57. Here, another thread color discriminating means may also be exemplified either by forming an open hole in the openable cover 61 for inspecting the thread bobbin 62 or by adhering a seal in the same color as that of the needle thread 24 to a portion of the surface of the cassette case 57.

As shown in FIG. 10, FIG. 16 and FIG. 28 to FIG. 33: the thread take-up lever travel region 57*b* is formed to have a width of about one third on the right side in the cassette case 57; the thread bobbin housing portion 57*a* is at an upper portion of about two thirds of the portion of a width of about two thirds on the left side in the cassette case 57; and the thread tension regulator housing portion 57*c* is at a lower portion of about one third of the portion of the width of about two thirds on the left side in the cassette case 57. The regions for the thread passage 59 are partitioned on the left end portion in the cassette body 60 by partitions 66 and 99.

In the thread take-up lever travel region 57*b* and in the rear wall of the cassette body 60, there is formed an elongated slit 101 for penetrating the thread guard 26 of the thread take-up lever 25 and a later-described thread guide member 106A. In the thread tension regulator housing portion 57*c* and in the rear wall and the bottom wall of the cassette body 60, there is formed a notch 96 for introducing the thread tension regulator 9 into the thread tension regulator housing portion 57*c*. Vertical partitions 67 and 100 are formed between the thread take-up lever travel region 57*b* and the thread bobbin housing portion 57*a* and the thread tension regulator housing portion 57*c*, and a horizontal support wall 63 for protruding toward the openable cover 61 is formed between the thread bobbin housing portion 57*c* and the thread tension regulator housing portion 57*a*.

The thread bobbin retaining portion 58 is constructed to retain the thread bobbin 62 vertically of its axis so that it can reduce the transverse width of the cassette case 57 and the sizes of the cassette case 57 and the cassette mount 3. The thread bobbin retaining portion 58 is constructed of the support wall 63 (corresponding to the wall of the housing portion) and a thread bobbin retaining pin 64. This thread bobbin retaining pin 64 is protruded upward from the support wall 63. The thread bobbin retaining pin 64 is divided into three portions in the circumferential direction so that it can be elastically deformed in a radially widening direction thereby to retain the thread bobbin 62 having axial bores of various sizes.

Of the support wall 63 and at the front end portion abutting against the lower end (or one axial end) of the thread bobbin 62, there is formed a recess 65 for pushing the thread bobbin 62 from below to take it up the thread bobbin retaining pin 64. This recess 65 is formed into a shape notched radially inward of the outer circumference of the thread bobbin 62 so that the needle thread 24 may not go into the clearance between the thread bobbin 62 and the support wall 63 even if it becomes slack.

Here will be described the thread passage 59. As shown in FIG. 14, FIG. 15 and FIG. 17 to FIG. 21, the thread passage 59 is an needle thread guide passage, which is based on a feed-out point 79 from the thread bobbin 62 retained on the thread bobbin retaining portion 58, for guiding the needle thread 24 fed out upward from the thread bobbin 62 to the thread exit 68 of the cassette case 57. The thread passage 59 includes a first guide portion 69, a first clamp portion 70, a second guide portion 71, a third guide portion 72 and a second clamp portion 73. With the thread bobbin 62 being retained by the thread bobbin retaining portion 58, the needle thread 24, as fed out upward from the thread bobbin 62, is guided through the first guide portion 69, the first clamp portion 70, the second guide portion 71, the third guide portion 72 and the second clamp portion 73 in the recited order to the thread exit 68 at the lower end portion near the right end of the cassette case 57.

As shown in FIG. 17, FIG. 19 and FIG. 22 to FIG. 25, the first guide portion 69 and the first clamp portion 70 are disposed in the upstream portion of the thread passage 59. The first guide portion 69 is disposed at the top of the cassette case 57. The first guide portion 69 is constructed to include a pin support member 74 formed in the cassette body 60, a guide pin 75 having an L-shape, as viewed in a top plan, protruding forward from the pin support member 74 and bent rightward, and a rib 76 formed on the openable cover 61 for preventing the thread from coming out.

The guide pin 75 is equipped with a thread guide portion having a predetermined length in the longitudinal direction.

Notched rectangular openings 77 and 78 are so formed in an opposed shape in the top walls of the cassette body 60 and the openable cover 61 as to cause the thread guide portion to face the outside, so that the needle thread fed from the thread bobbin of the outside can be introduced from the openings 77 and 78 into the first guide portion 69. The needle thread 24 fed out from the thread bobbin 62 is so engaged with the thread guide portion of the guide pin 75 as to move freely in the longitudinal direction. Even in case the distance between the thread bobbin 62 and the first guide portion 69 is not so long, therefore, the needle thread 24 can be smoothly pulled out from the thread bobbin 62.

Figure 23:
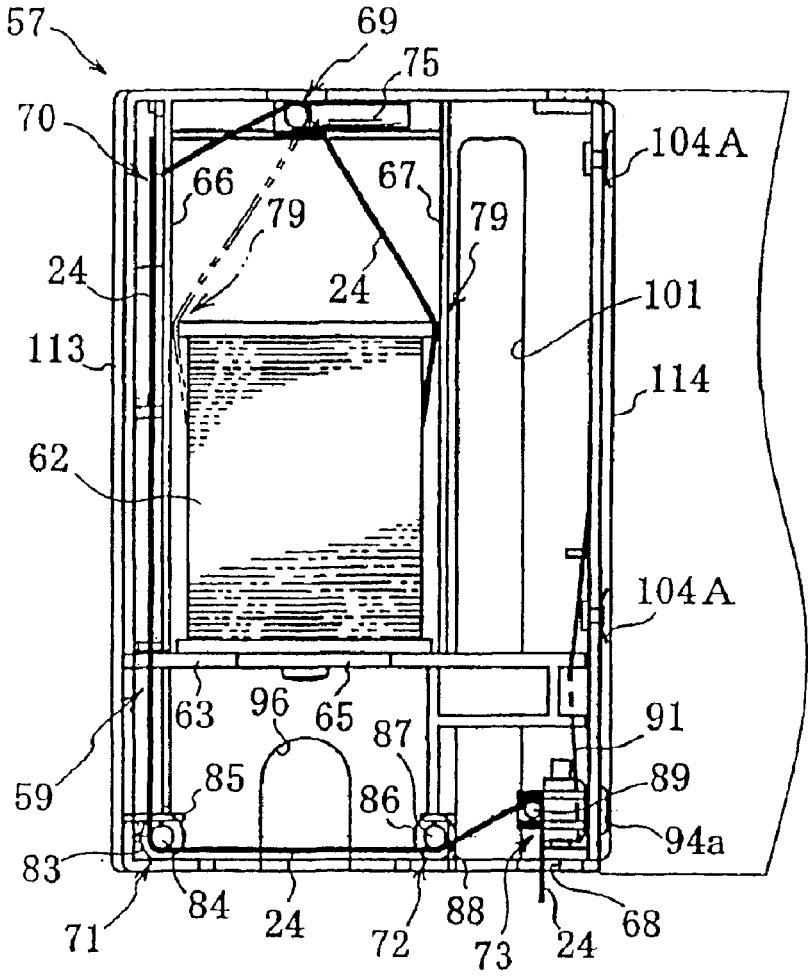
FIG. 23 is a front elevation of the needle thread cassette (in the state where an openable cover is opened).
Figure 24:
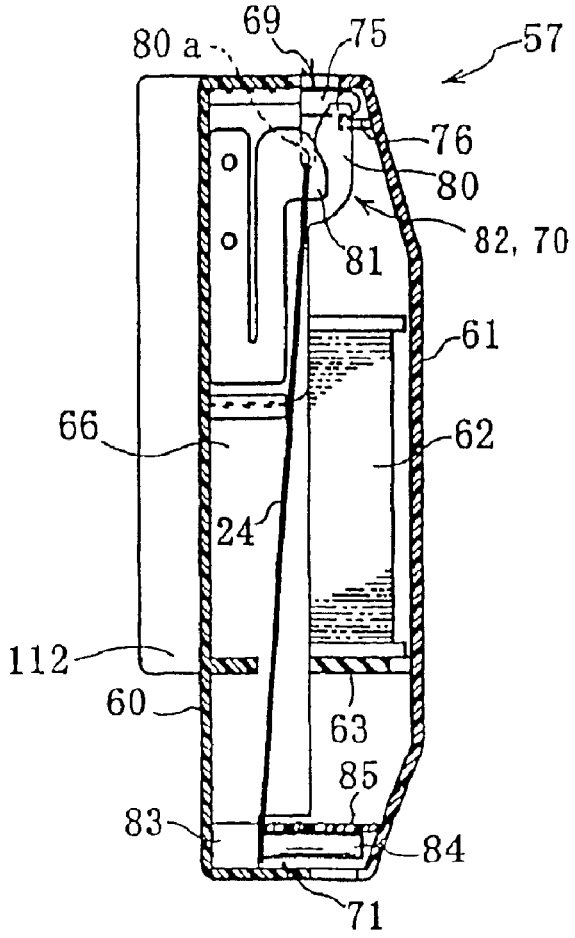
FIG. 24 is a longitudinally sectional side elevation of the needle thread cassette.
Figure 25:
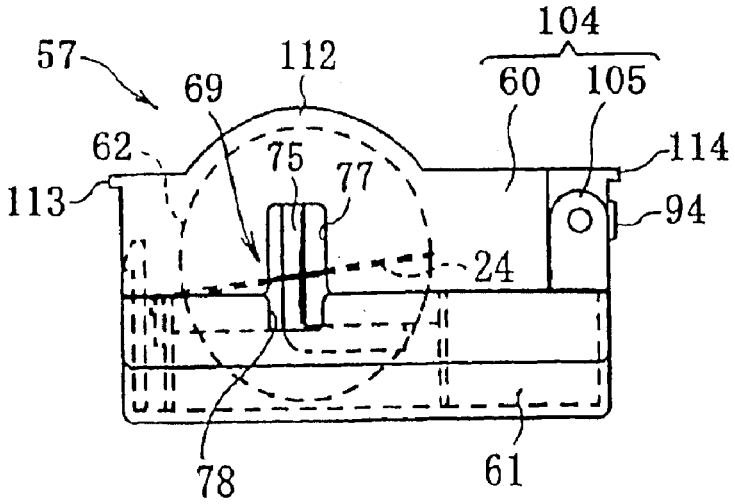
FIG. 25 is a top plan view of the needle thread cassette.
Figure 26:
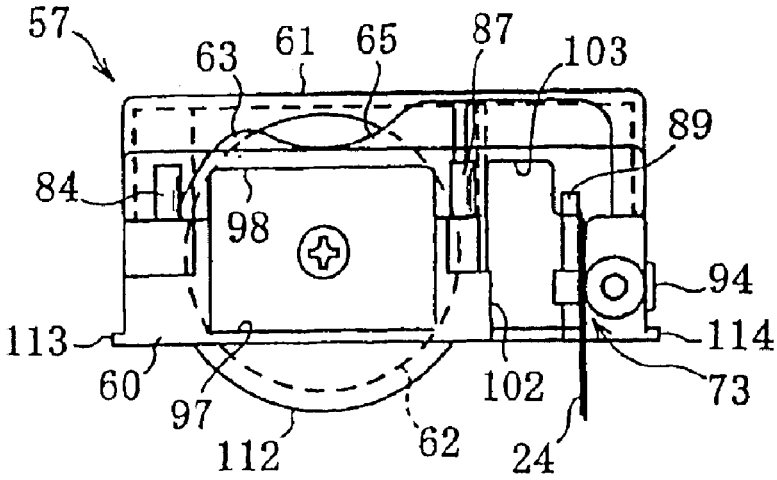
FIG. 26 is a bottom view of the needle thread cassette.
Figure 27:
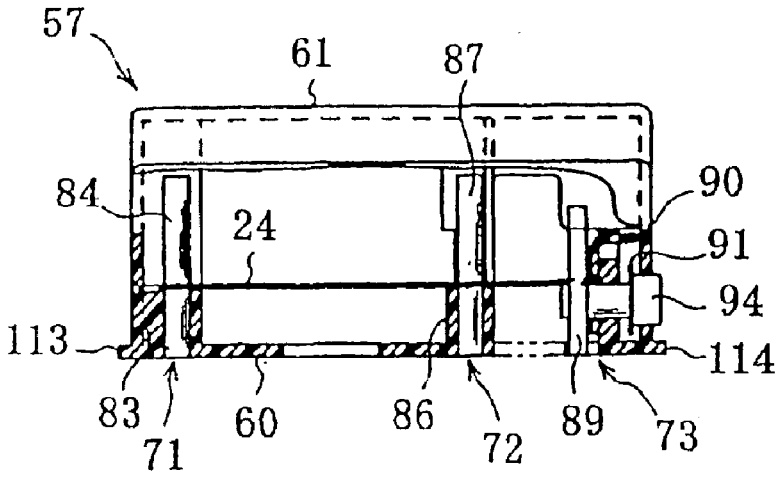
FIG. 27 is a partially cut-away transverse top plan view of the needle thread cassette and shows the downstream portion of a thread passage.
Figure 28:
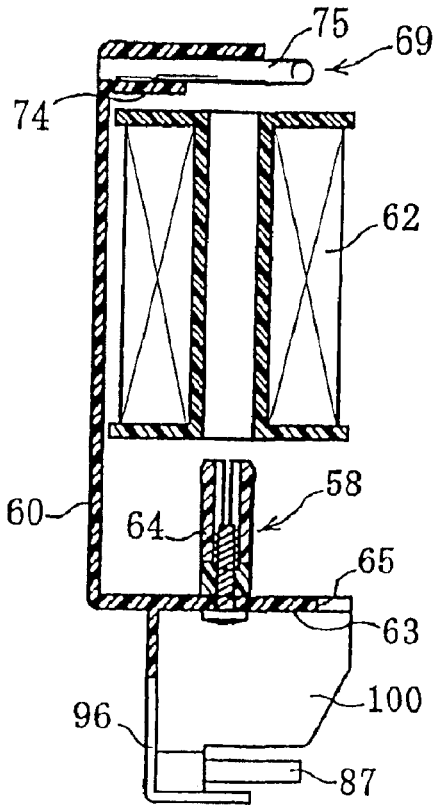
FIG. 28 is a longitudinally sectional side elevation of a cassette body and a thread bobbin (in the state before mounted).
Figure 29:
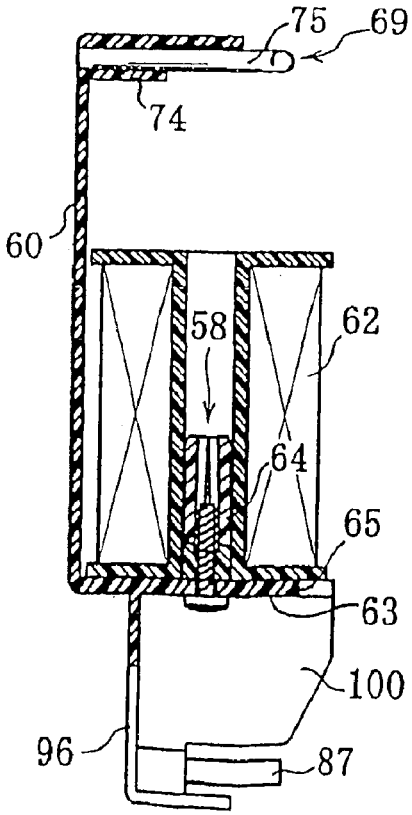
FIG. 29 is a longitudinally sectional side elevation of the cassette body and the thread bobbin (in the state after mounted).
Figure 30:
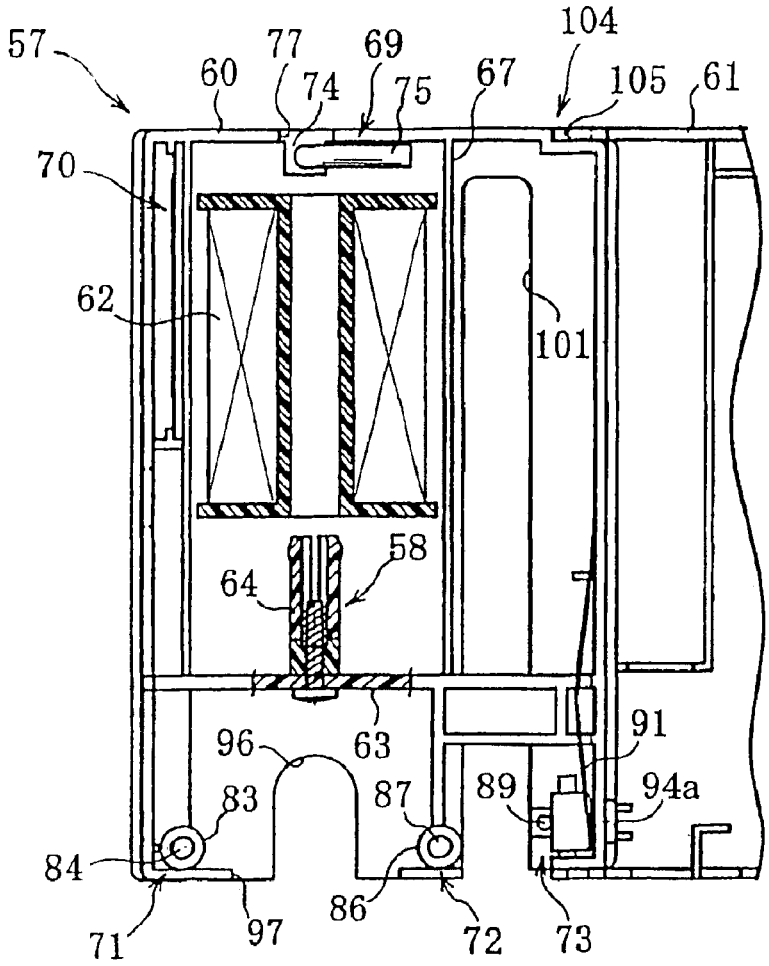
FIG. 30 is a front elevation of the needle thread cassette (in the state where the openable cover is opened).
Figure 31:
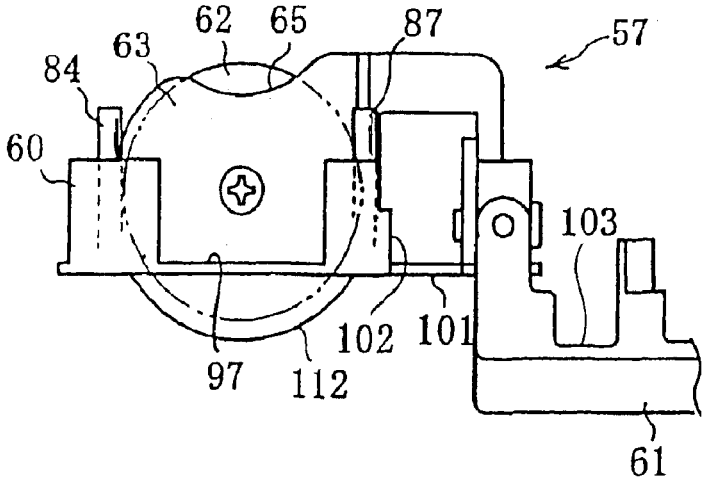
FIG. 31 is a bottom view of the needle thread cassette (in the state where the openable cover is opened).
Figure 32:
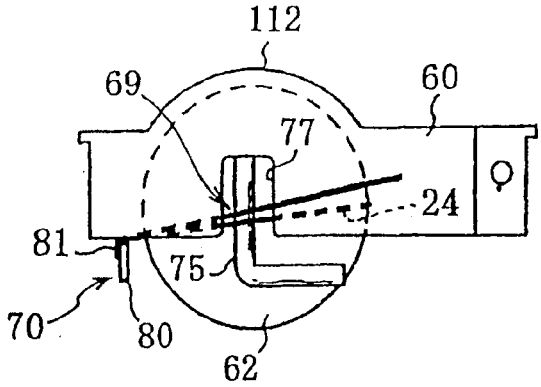
FIG. 32 is a top plan view of the cassette body and shows a first guide portion.
Figure 33:
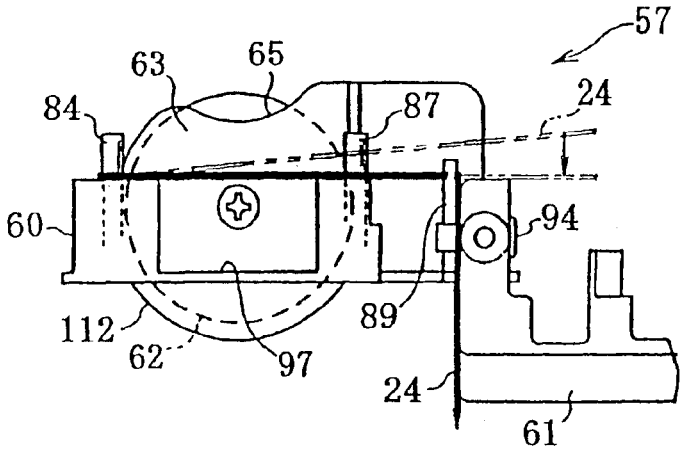
FIG. 33 is a bottom view of the needle thread cassette and shows second and third guide portions and the second clamping portion.
Figure 34:
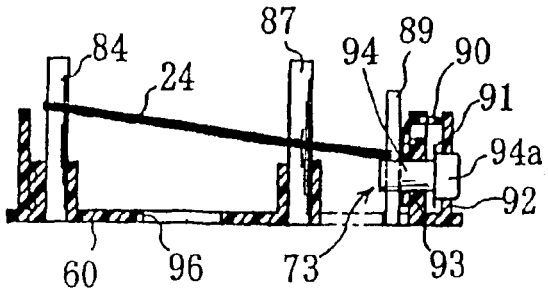
FIG. 34 is a transverse section of the cassette body and shows the second and third guide portions and the second clamping portion.

The first clamp portion 70 will be described in the following. As shown in FIG. 23 and FIG. 24, the first clamp portion 70 applies the passing resistance to the needle thread 24 in the upstream portion of the thread passage 59 and prevents the thread from being twisted and interlaced with each other. This first clamp portion 70 is disposed near the upper end of the left end portion in the cassette case 57. The first clamp portion 70 is constructed of a thread twist preventing mechanism 82 including a presser plate 80 having a thread guide portion 80*a* and a leaf spring 81 for pressing the needle thread 24 onto the presser plate 80.

The presser plate 80 and the leaf spring 81 are fixed on the partition 66 of the cassette body 60.

The thread guide portion 80*a* of the presser plate 80 is a narrow notch opened upward and protruding forward of the cassette body 60. The leaf spring 81 abuts against the left side face of the thread guide portion 80*a* to clamp the needle thread 24 between itself and the thread guide portion 80*a*, and applies the passing resistance to the needle thread 24 to prevent the needle thread 24 from being twisted and interlaced.

Next, the second and third guide portions 71 and 72 and the second clamp portion 73 are disposed in the downstream portion of the thread passage 59, as shown in FIG. 14, FIG. 15, FIG. 17 to FIG. 21, FIG. 26 and FIG. 27. The second guide portion 71 is located at the lower end portion of the left end portion in the cassette case 57; the third guide portion 72 is located at the lower end portion of the boundary between the thread tension regulator housing portion 57*c* and the thread take-up lever travel region 57*b* in the cassette case 57; and the second clamp portion 73 is located near the lower end of the right end in the cassette case 57.

The needle thread 24 extends obliquely from the first guide portion 69 to the first clamp portion 70, vertically from the first clamp portion 70 to the second guide portion 71, horizontally from the second guide portion 71 to the third guide portion 72, and generally horizontally or at an inclination from the third guide portion 72 to the second clamp portion 73. Thus, the needle thread 24 is guided to cross along the lower end portion of the cassette case 57.

The second guide portion 71 is constructed of a pin support portion 83 disposed at the rear wall portion of the cassette body 60, a guide pin 84 fixed on the pin support portion 83 and protruding forward, and a rib 85 formed on the openable cover 61 for preventing the thread from coming out. The pin support portion 83 and the rib 85 set the longitudinal position of the needle thread 24 properly. The third guide portion 72 is constructed of a pin support portion 86 disposed at the rear wall portion of the cassette body 60, a guide pin 87 fixed on the pin support portion 86 and protruding forward, and a rib 88 formed on the openable cover 61 for preventing the thread from coming out. The pin support portion 86 and the rib 88 set the longitudinal position of the needle thread 24 properly.

The second clamp portion 73 will be described in the following. As shown in FIG. 14, FIG. 15, FIG. 17 to FIG. 21 and FIG. 33 to FIG. 36, the second clamp portion 73 applies the passing resistance to the needle thread 24 in the vicinity of the thread exit 68. No matter whether the needle thread cassette 2 might be neither mounted in the cassette mount 3 nor completely mounted, the second clamp portion 73 is constructed to apply a higher passing resistance to the needle thread 24 than the first clamp portion 70. When the needle thread 24 is engaged with the thread guard 26 of the thread take-up lever 25 and the thread tension regulator 9 at the time of mounting the needle thread cassette 2, therefore, the needle thread 24 is kept in the tensed state between the second guide portion 71 and the second clamp portion 73. Therefore, the thread guard 26 of the thread take-up lever 25 and the thread tension regulator 9 can be reliably threaded, and the needle thread 24 necessary for the threading operation can be reliably fed out from the thread bobbin 62. In other words, the third guide portion 72 and the second clamp portion 73 function as the needle thread control portion for controlling the needle thread 24 when the thread guard 26 of the thread take-up lever 25 is to be threaded.

The second clamp portion 73 is constructed of a movable pin member 94 having an axis directed horizontally in the transverse direction, a guide pin 89 for guiding the needle thread 24, a thread retaining plate 90 and a leaf spring member 91. The movable pin member 94 is composed of a radially smaller pin portion, and a radially larger control button 94*a*, which is enabled to go into and out of the right side face of the lower end portion of the cassette body 60. The movable pin member 94 is so mounted in vertical wall portions 92 and 93 near the right end and the lower end of the cassette body 60 as to move horizontally in the transverse direction, and is elastically biased rightward by the leaf spring member 91.

The guide pin 89 is longitudinally inserted and fixed at its rear end portion in the left end portion of the movable pin member 94, and the thread retaining plate 90 for retaining the needle thread 24 between itself and the guide pin 89 is fixed between the guide pin 89 and the left side face of the vertical wall portion 93, so that the passing resistance is applied to the needle thread 24 by clamping the needle thread 24 between the guide pin 89 biased rightward together with the movable pin member 94 and the thread retaining plate 90.

Figure 14:
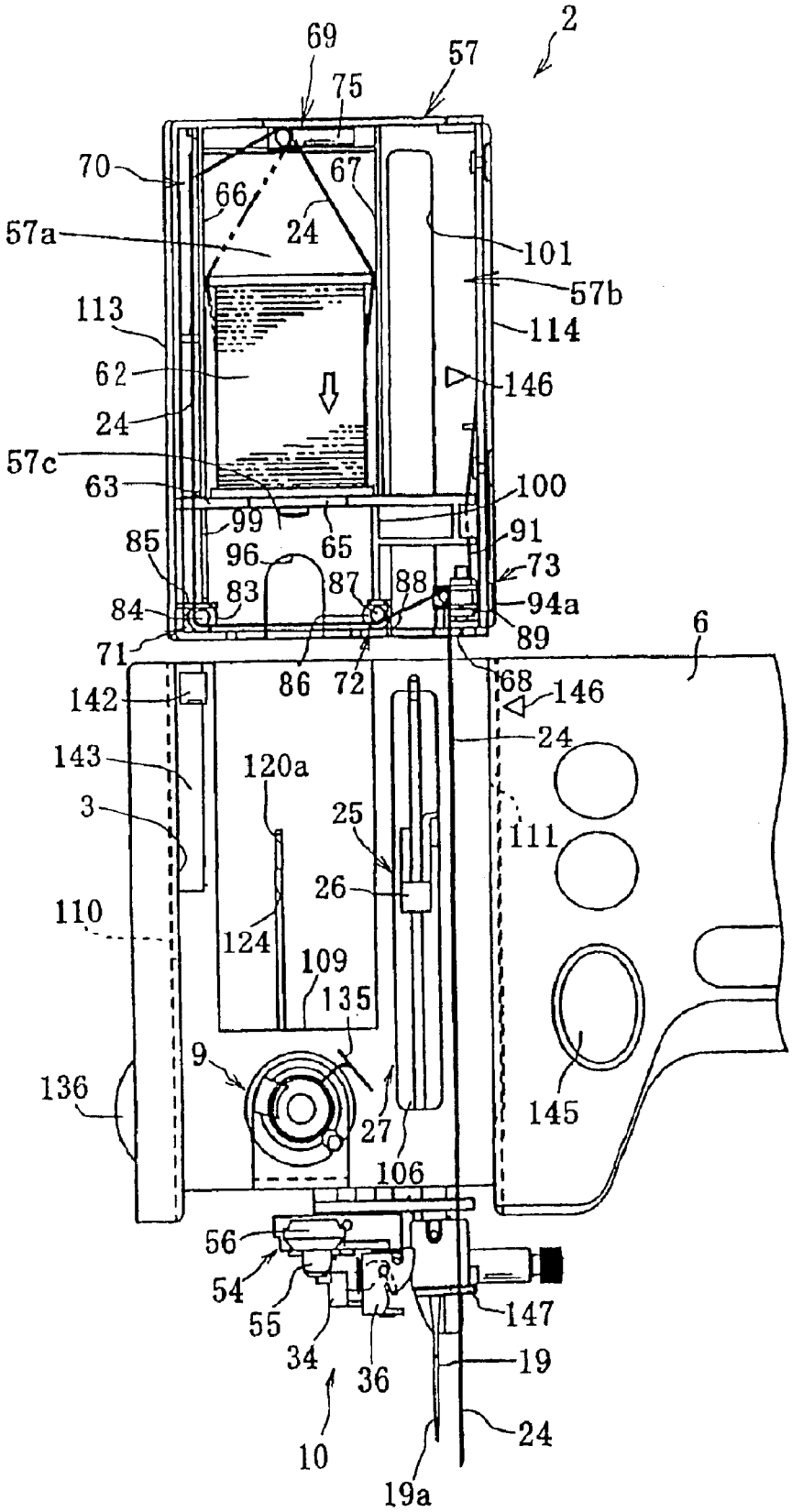
FIG. 14 is a front elevation of the needle thread cassette (in the state immediately before mounted) and the cassette mounting portion.
Figure 18:
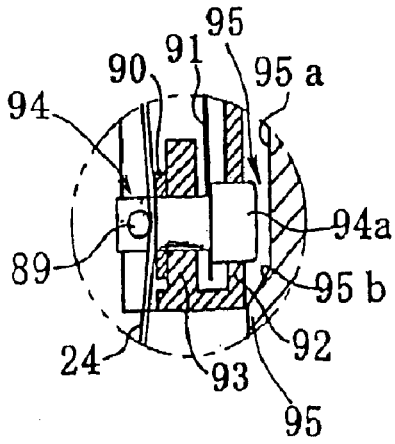
FIG. 18 is a partially enlarged section of a second clamping portion and a cam.

In the state where the needle thread cassette 2 is taken out from the cassette mount 3, as shown in FIG. 14 and FIG. 18, the leading end portion of the control button 94*a* is protruded from the right side face of the cassette body 60 by the biasing force of the leaf spring member 91. In case the needle thread 24 is fed out from the thread bobbin 62 while the needle thread cassette 2 is not mounted in the cassette mount 3, therefore, the movable pin member 94 and the guide pin 89 are moved leftward to open the second clamp portion 73 by pushing the control button 94*a* with the finger of the operator, so that the needle thread 24 can be fed out against the passing resistance of the first clamp portion 70. With the needle thread cassette 62 is completely mounted in the cassette mount 3, therefore, the second clamp portion 73 takes an open state to apply no passing resistance to the needle thread 24, as will be described hereinafter.

Figure 19:
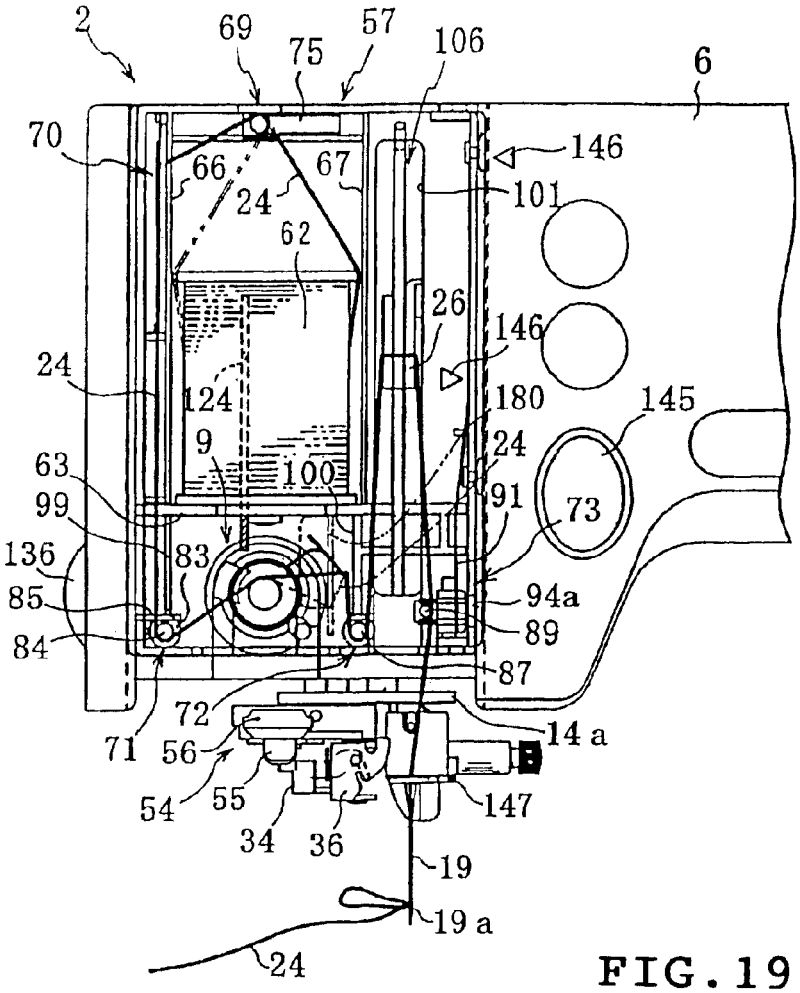
FIG. 19 is a front elevation of the needle thread cassette (in the state after the mounting was completed) and the arm head.
Figure 20:
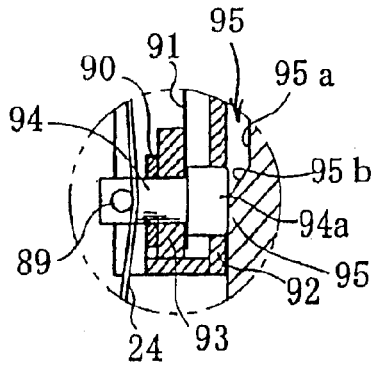
FIG. 20 is a view corresponding to FIG. 18 and shows the second clamping portions (in the opened state) and the cam.

Even in the state where the needle thread cassette 2 is completely mounted in the cassette mount 3, as shown in FIG. 19 and FIG. 20, the second clamp portion 73 is brought into the open state. For this, the cassette mount 3 is provided at its right side wall with a vertical groove 95*a* for releasing the control button 94*a*, and an needle thread releasing cam 95 for bringing the control button 94*a* into a retracted state in the state where the needle thread cassette 2 is completely mounted. These components will be described later together with the description of the cassette mount 3.

With the needle thread cassette 2 being completely mounted in the cassette mount 3, the second clamp portion 73 takes an open state, but the needle thread 24 is clamped by the thread tension regulator 9 being penetrated into the thread tension regulator housing portion 57*c* of the needle thread cassette 57 and is given the passing resistance, so that the needle thread 24 between the first clamp portion 70 and the thread tension regulator 9 keeps the tensed state. This prevents the needle thread 24 in the thread passage 59 upstream of the thread tension regulator 9 from being twisted or interlaced.

Here, the thread tension regulator 9 need not be mounted in the arm 6 but can be mounted in the needle thread cassette 2. In this modification, too, the needle thread 24 between the first clamp portion 70 and the thread tension regulator 9 can be kept in the tensed state thereby to prevent the thread from being twisted or interlaced.

As described above, the needle thread 24 is clamped by the first clamp portion 70 and is clamped between later-described thread tension discs of the thread tension regulator 9 and given the passing resistance so that the needle thread is tensed between the discs. When the needle thread is clamped and resisted in this case at the entrance portion of the thread tension discs of the thread tension regulator 9, its structurally intrinsic twist is intensified at that portion. Therefore, the twist intensified more than the structurally intrinsic one is always given to the needle thread portion between the first clamp portion 70 and the thread tension discs of the thread tension regulator 9.

If the needle thread portion becomes slack, it is partially bent to cause the phenomenon that the threads are interlaced with each other at that part into a linear or entangled shape. If this interlaced part is guided to the thread tension discs of the thread tension regulator 9, it is caught by the discs so that it is cut or frayed.

By clamping the needle thread 24 with the first clamp portion 70 and the thread tension discs of the thread tension regulator 9 to tense the clamped thread portion, however, it is possible to eliminate the aforementioned interlaced phenomenon. Here, the needle thread portion having passed through the thread tension discs of the thread tension regulator 9 is released from the intensified twist as described above.

Here will be described the construction for penetrating the thread tension regulator 9 into the thread tension regulator housing portion 57*c* in the cassette case 57 when the needle thread cassette 2 is to be mounted in the cassette mount 3. Below the thread tension regulator housing portion 57*c*, as shown in FIG. 1, FIG. 14, FIG. 15, FIG. 23, FIG. 26, FIG. 30 and FIG. 31, notched rectangular openings 97 and 98 are formed in an opposed shape in the bottom walls of the cassette body 60 and the openable cover 61, and the partially elliptic notch 96 leading to the opening 97 is formed in the rear wall portion of the cassette body 60. When the needle thread cassette 2 is to be mounted, the thread tension regulator 9 is penetrated and housed in the thread tension regulator housing portion 57*c* through the notch 96 and the openings 97 and 98.

Below the thread take-up lever travel region 57*b*, as shown in FIG. 1, FIG. 3, FIG. 11 to FIG. 15, FIG. 26, FIG. 27, FIG. 30 and FIG. 31, notched rectangular openings 102 and 103 are formed in an opposed shape in the bottom walls of the cassette body 60 and the openable cover 61, and the elongated slit 101 leading to the opening 102 and extending from the lower end up to the upper end is formed in the rear wall of the cassette body 60. When the needle thread cassette 2 is to be mounted in the cassette mount 3, the thread guard 26 of the thread take-up lever 25 and the thread guide 106A are penetrated and introduced into the cassette case 57 through those openings 102 and 103 and slit 101.

Figure 21:
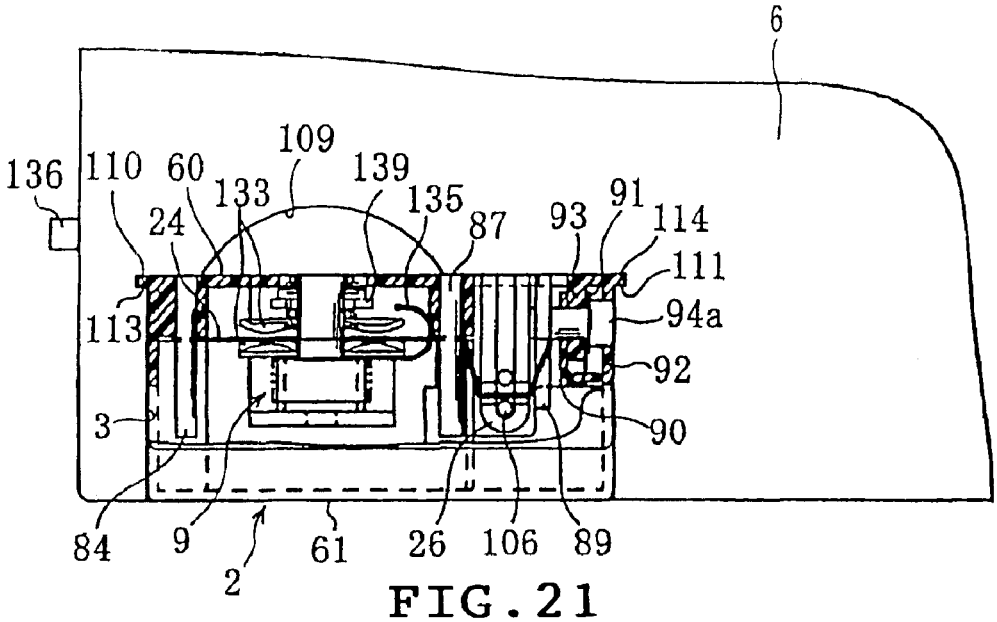
FIG. 21 is a transverse section of the needle thread cassette mounted in the cassette mounting portion.
Figure 22:
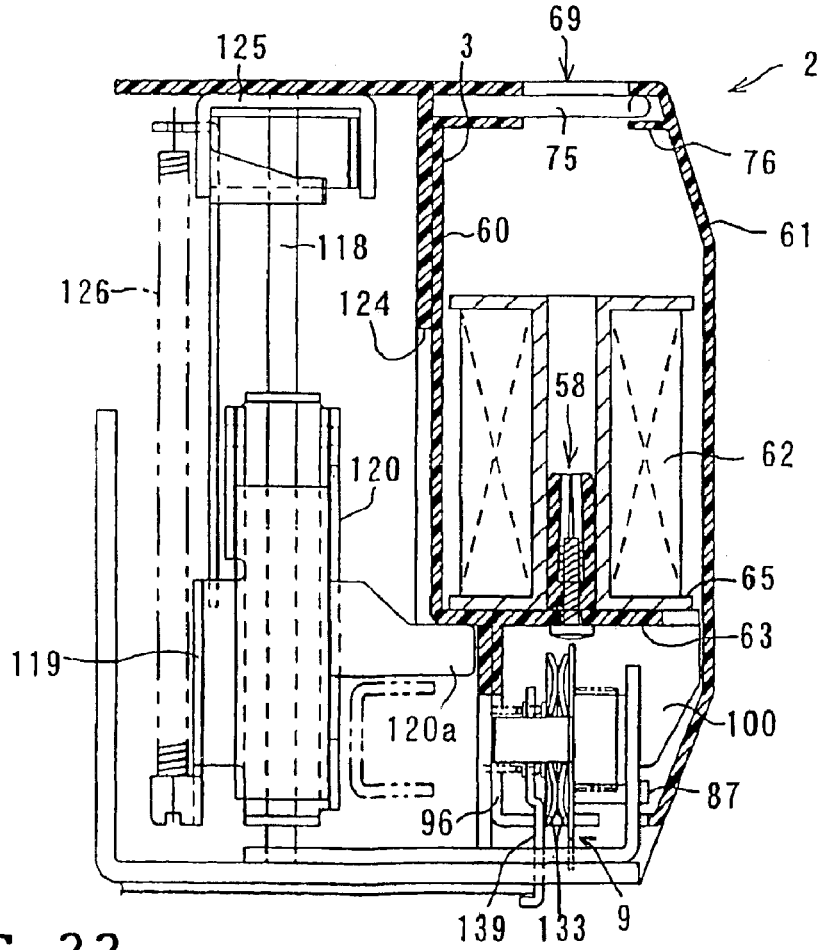
FIG. 22 is a longitudinally sectional side elevation of the needle thread cassette (in the state where the mounting is completed) and the cassette mounting portion.

As shown in FIG. 21, FIG. 22 and FIG. 24, such a rear wall of the cassette body 60 as faces the thread bobbin housing portion 57*a* bulges backward in a partially cylindrical shape for housing the thread bobbin 62, and the portion corresponding to the lower end of the partially cylindrical portion is provided with an engaging portion 112 for engaging from above with a later-described receiving portion 109 of the cassette mount 3 to determine the height position of the needle thread cassette 2. On the two left and right end portions of the rear wall of the cassette body 60, there are formed ridged engaging portions 113 and 114, which can engage with later-described guide grooves 110 and 111 of the cassette mount 3, respectively. With the needle thread cassette 2 being mounted in the cassette mount 3, the front face of the openable cover 61 is flush with the front face of the arm 6, and the upper walls of the cassette body 60 and the openable cover 61 are flush with the upper face of the arm 6 (as referred to FIG. 19 and FIG. 22).

Figure 35:
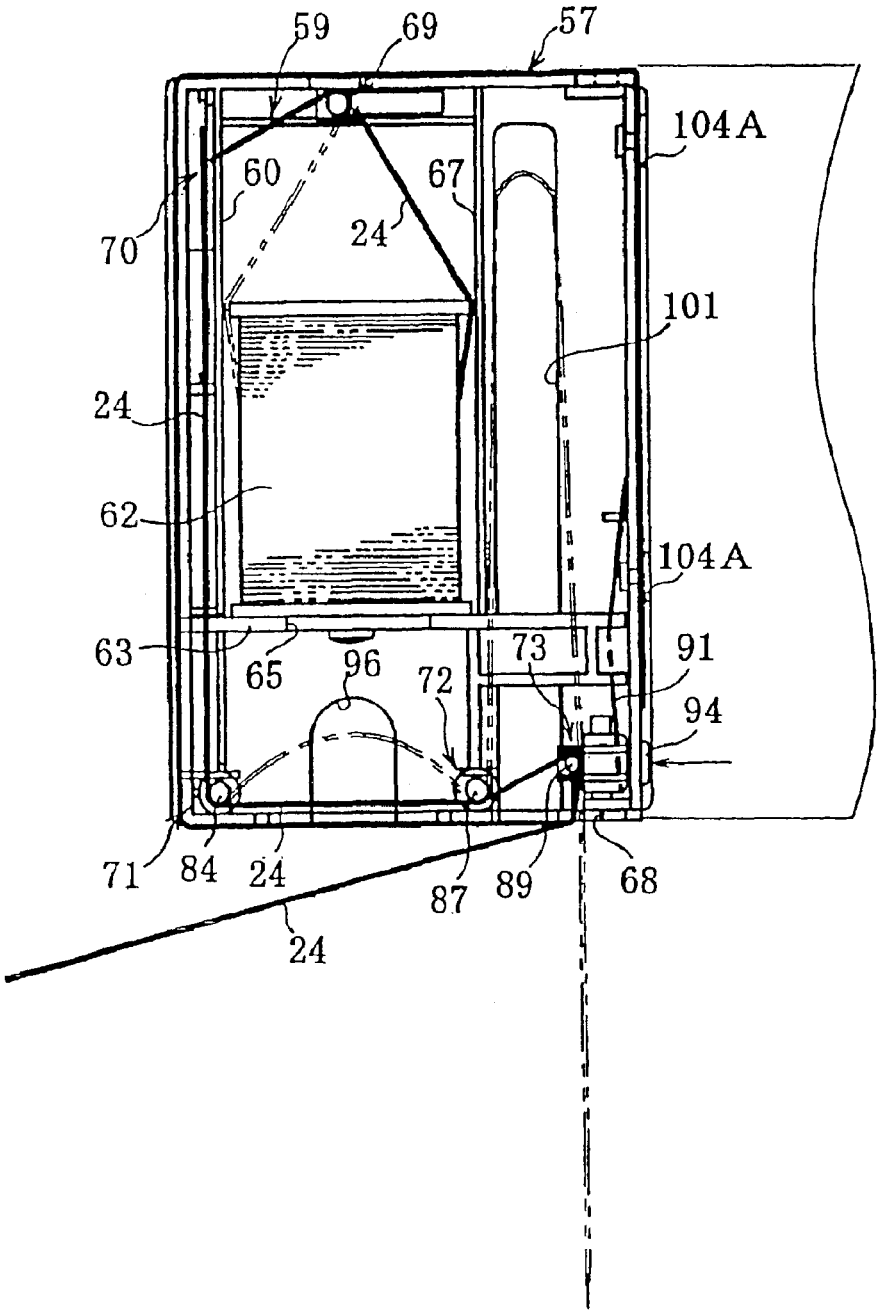
FIG. 35 is a front elevation of the needle thread cassette for explaining a thread holding procedure.
Figure 36:
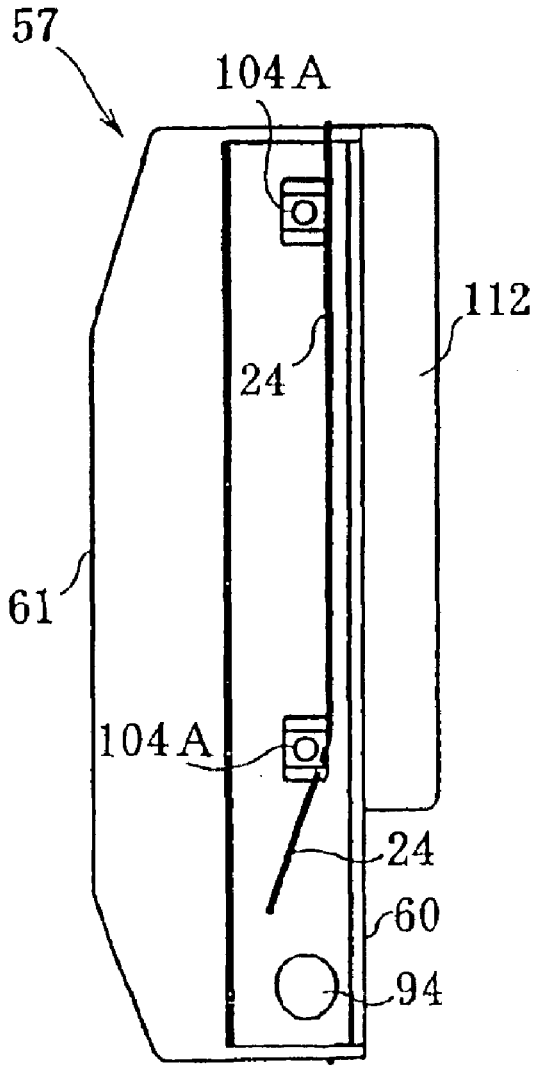
Figure 37:
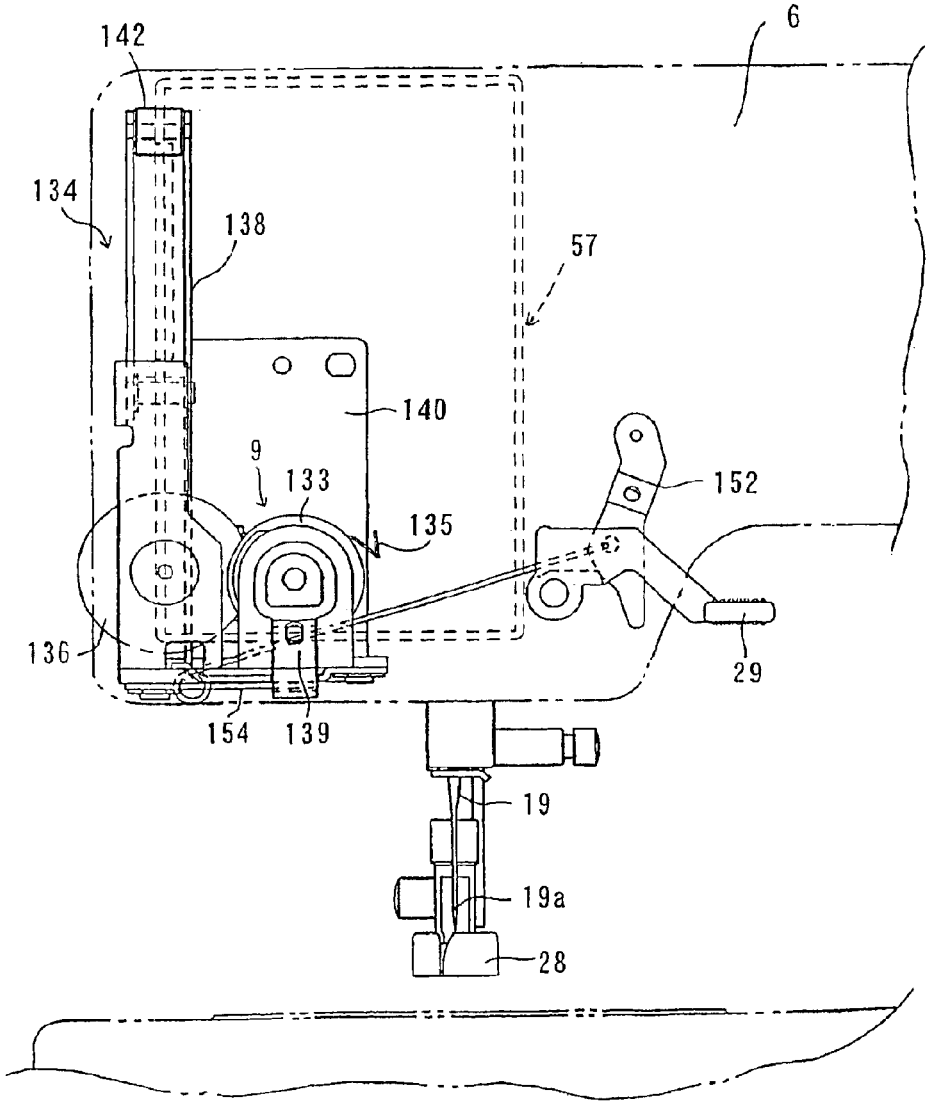
Figure 38:
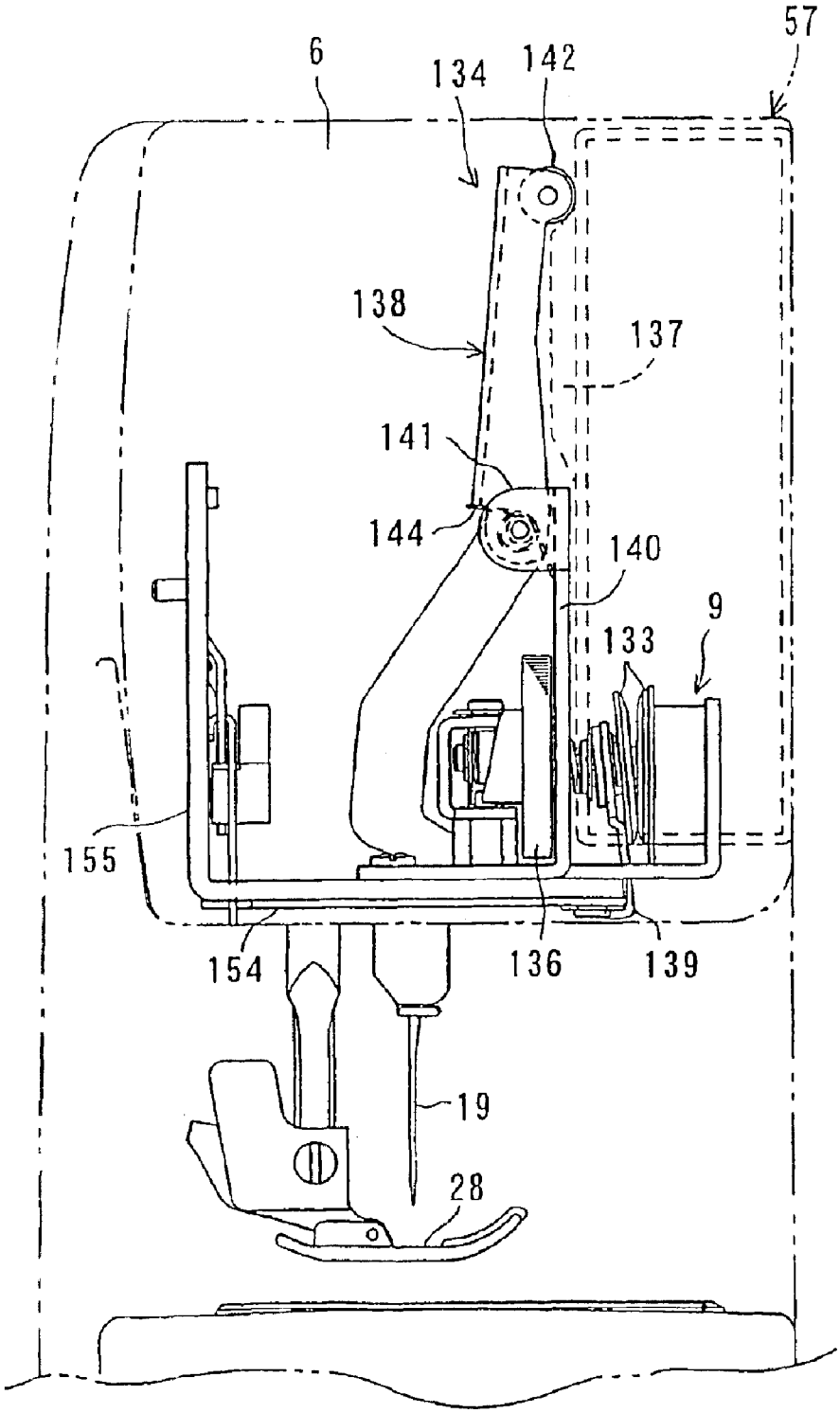
Figure 39:
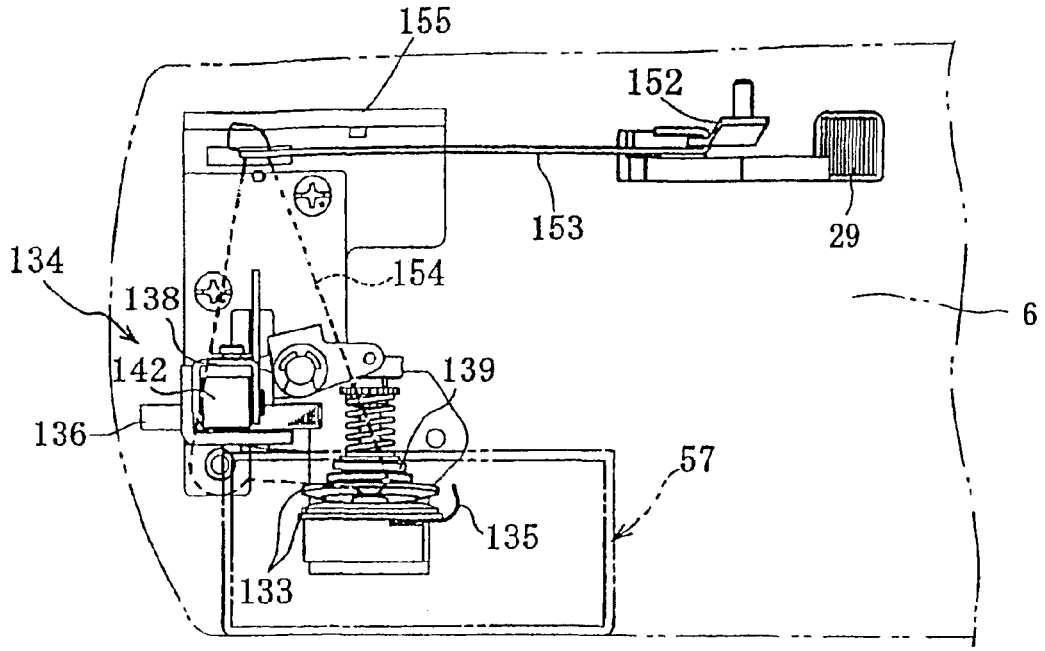
Figure 40:
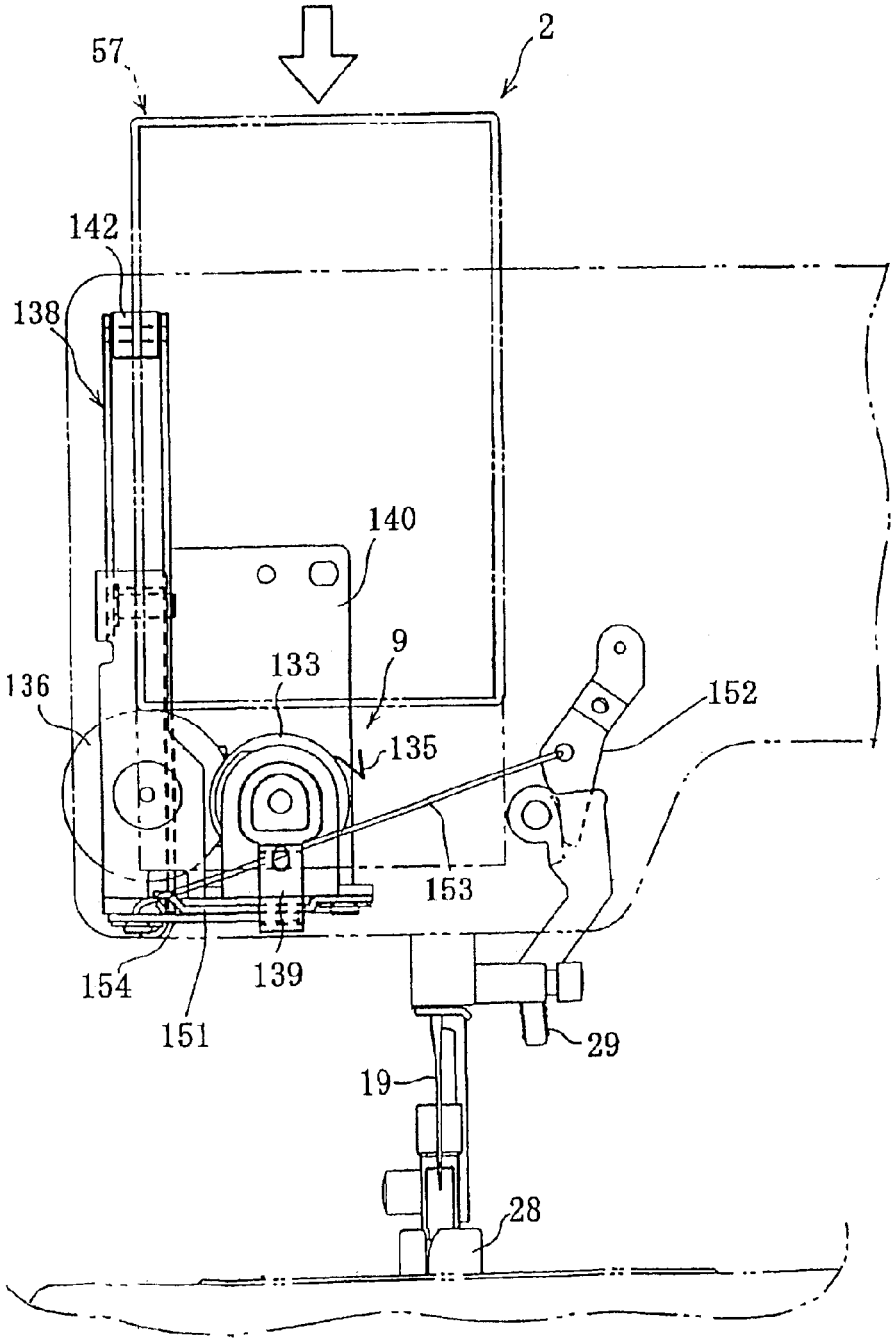
FIG. 40 is a view corresponding to FIG. 37 and shows the state where the needle thread cassette is mounted.
Figure 41:
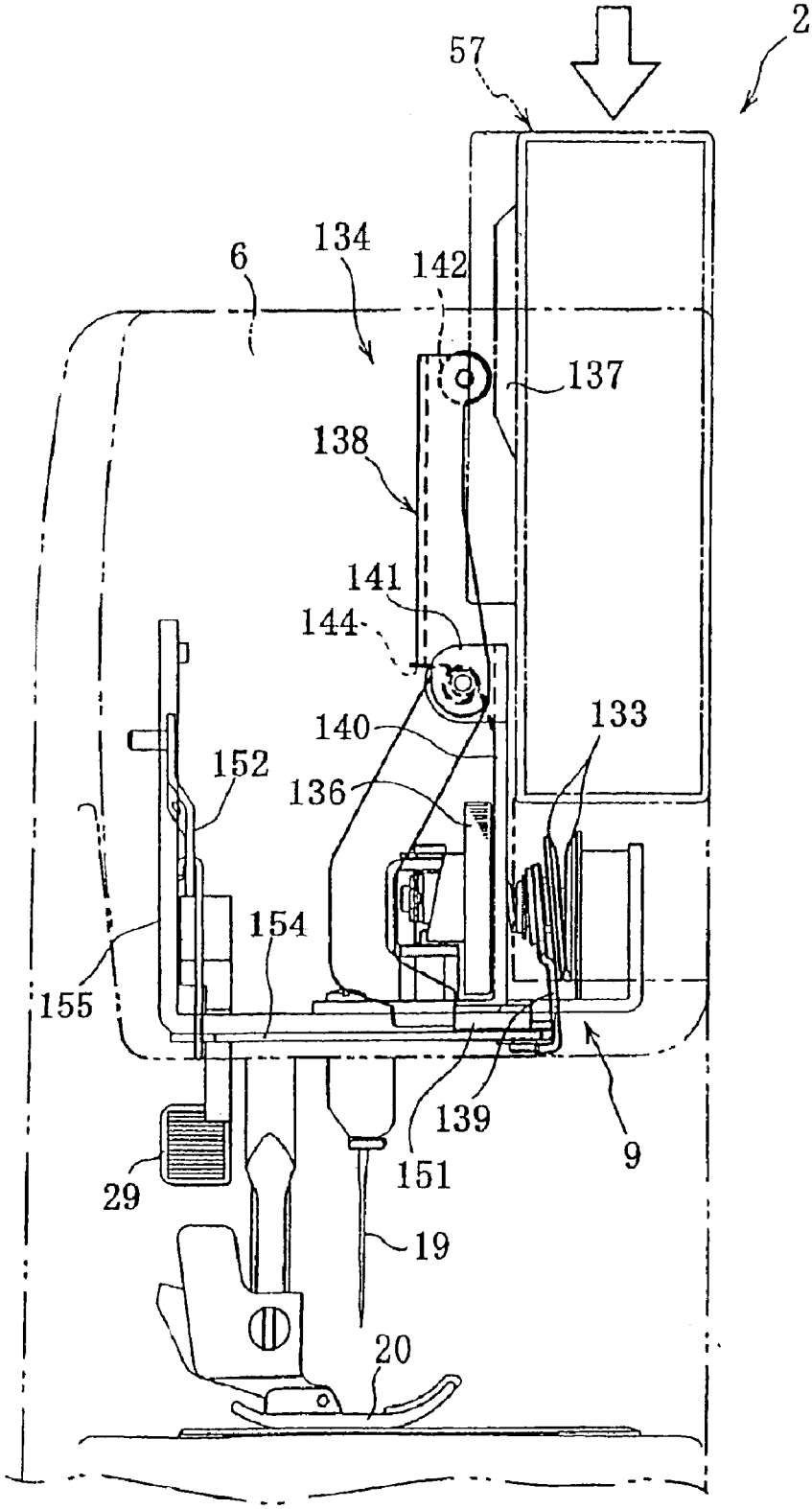
FIG. 41 is a view corresponding to FIG. 38 and shows the state where the needle thread cassette is mounted.
Figure 42:
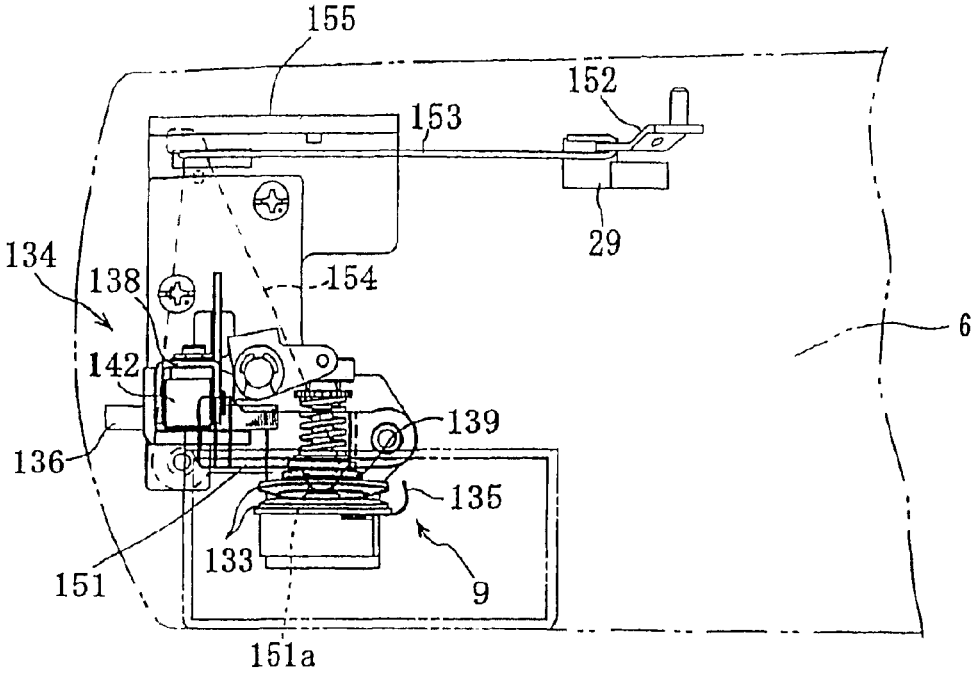
FIG. 42 is a view corresponding to FIG. 39 and shows the state where the needle thread cassette is being mounted.
Figure 43:
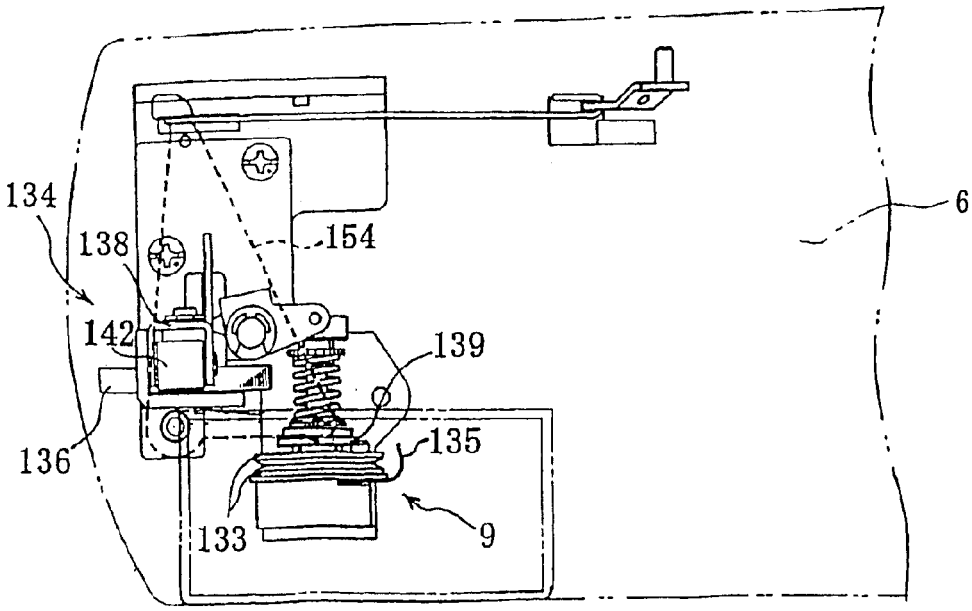
FIG. 43 is a view corresponding to FIG. 39 and shows the state after the mounting of the needle thread cassette is completed.
Figure 44:
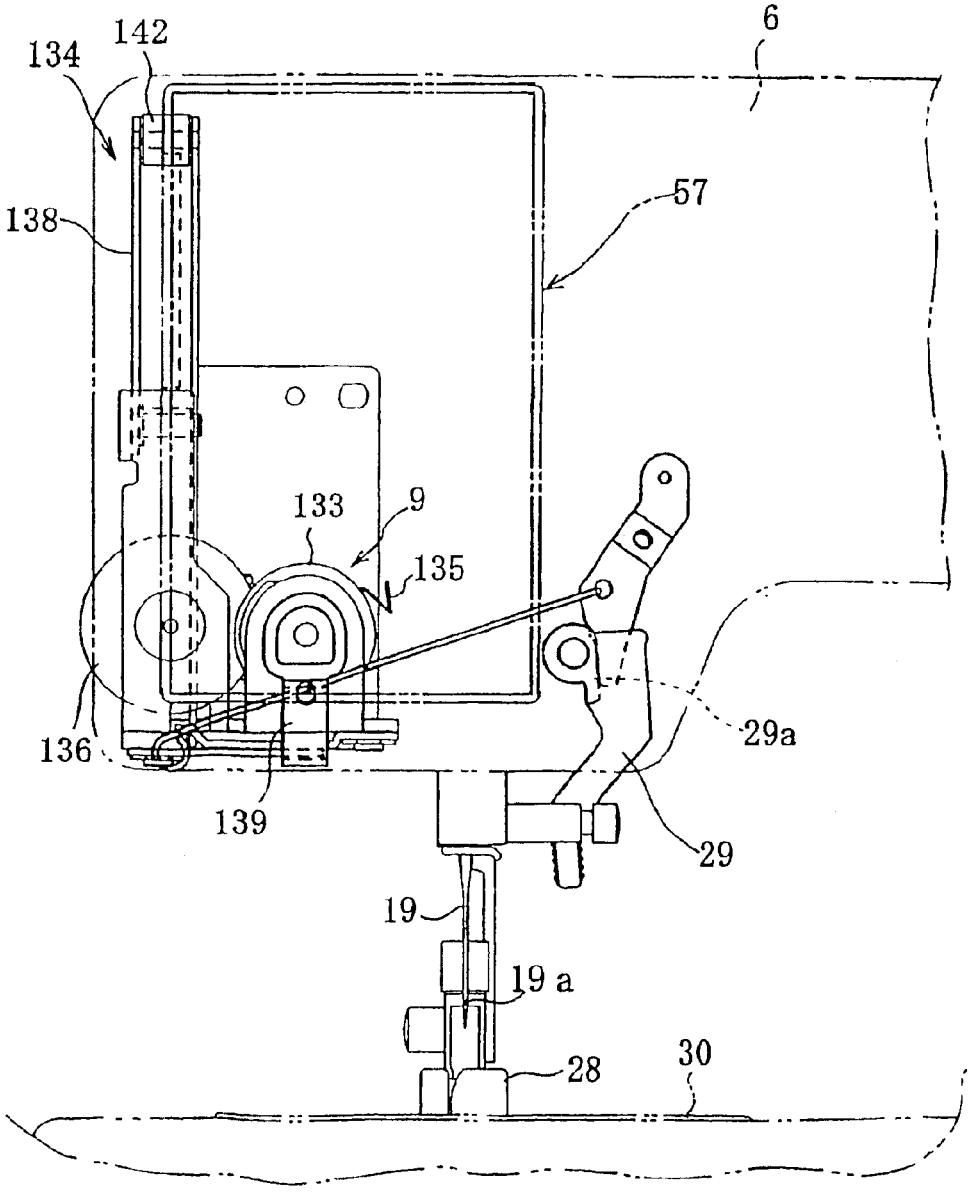
FIG. 44 is a view corresponding to FIG. 37 and shows the state after the mounting of the needle thread cassette is completed.
Figure 45:
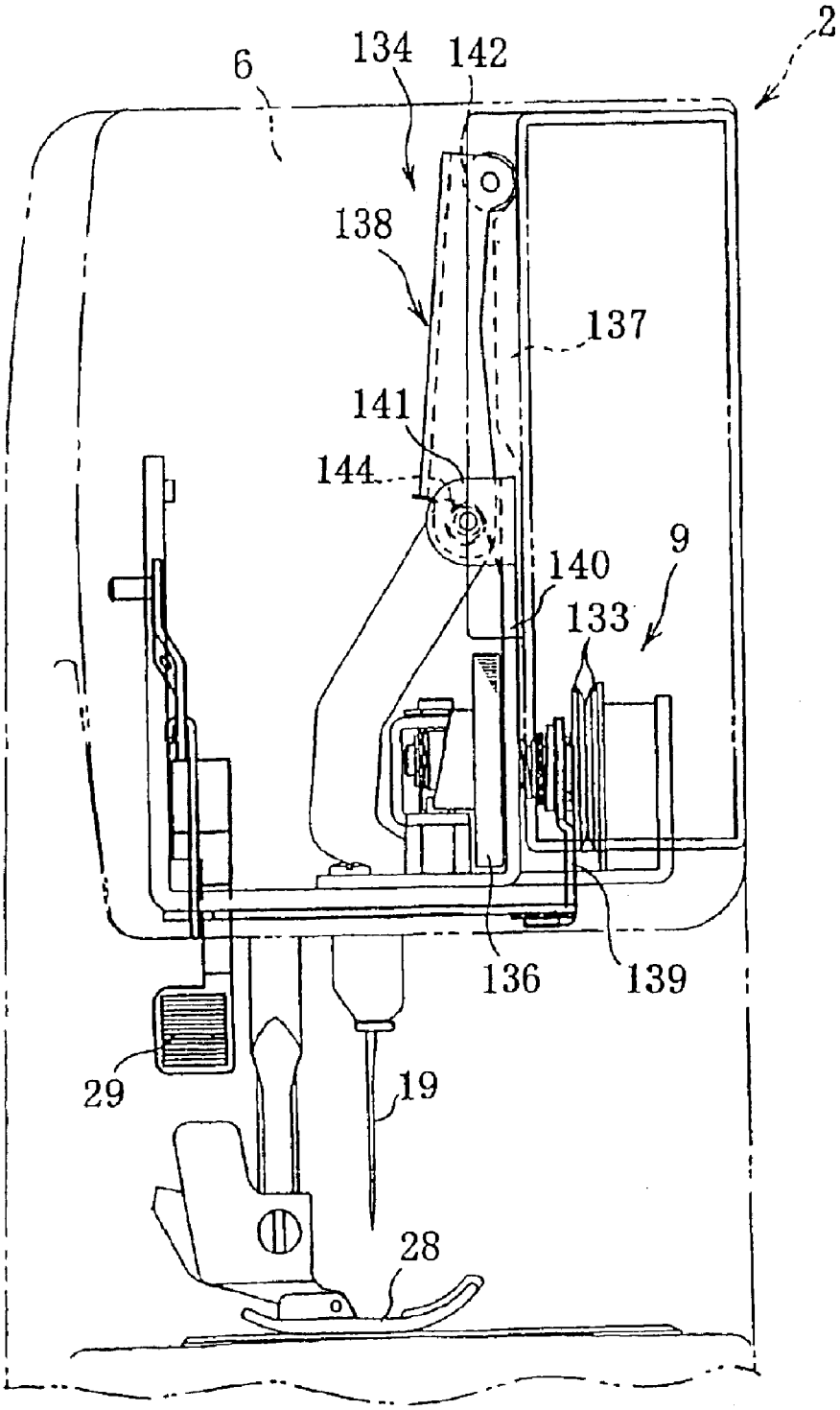
FIG. 45 is a view corresponding to FIG. 38 and shows the state after the mounting of the needle thread cassette is completed.

Next, a thread holder 104 of the needle thread cassette 2 will be described in the following. As shown in FIG. 25, FIG. 30, FIG. 35 and FIG. 36, the thread holder 104 is constructed such that the end side portion of the needle thread 24 extending to the outside of the needle thread cassette 2 is temporarily held between a chamfered portion 105 of the hinged portion of the openable cover 61 of the outer face portion of the cassette case 57 and the cassette body 60 to contact with the chamfered portion 105 when the openable cover 61 is closed. The chamfered portion 105 and a portion of the cassette body 60 construct the thread holder 104. However, a thread holder 104A may also be constructed by providing the outer face portion of the cassette case 57 with a leaf spring member biased to the case and by holding the end portion of the needle thread 24 temporarily on the leaf spring member as shown in FIG. 35 and FIG. 36.

Here will be described the cassette mount 3 for mounting the needle thread cassette 2 removably from above. As shown in FIG. 1, FIG. 2, FIG. 4 and FIG. 21, the cassette mount 3 as the controller mounting portion is so formed at the front face of the leading end portion (or the arm head) of the arm 6 of the sewing machine as to have a longitudinally long rectangular shape, as viewed in a front elevation, and a transversely short grooved section. The cassette mount 3 is provided on the right end side with the vertically long thread take-up lever travel region 27, in which the thread guard 26 of the thread take-up lever 25 reciprocates, and its substantial portion excepting the thread take-up lever travel region 27 is located on the left side of the thread take-up lever travel region 27.

The cassette mount 3 is shaped to have its upper end and lower end opened so that the needle thread cassette 2 may be able to be mounted from above in the vertical direction and removed to above in the vertical direction with the axis of the thread bobbin 62 retained in the thread bobbin retaining portion 58 being generally in parallel with the reciprocating direction of the thread guard 26 of the thread take-up lever 25. Near the lower end of the portion, as located rather on the left than the center, of the cassette mount 3, the thread tension regulator 9 is disposed to protrude forward with its axis being directed in the longitudinal direction. In the lower portion of the rear wall of the cassette mount 3, there is formed the stepped receiving portion 109 for receiving the engaging portion 112 of the needle thread cassette 2 to position the needle thread cassette 57 at a predetermined height. Near the rear ends of the left side wall and the right side wall of the cassette mount 3, respectively, there are formed the guide grooves 110 and 111 for introducing and guiding the engaging portions 113 and 114 of the needle thread cassette 2 slidably.

Here will be described the needle thread releasing cam 95, which is disposed at the cassette mount 3 for switching the second clamp portion 73 into the open state. At the rear portion of the right side wall of the cassette mount 3, as shown in FIG. 18 and FIG. 20, there are formed the aforementioned vertical groove 95*a* and the needle thread releasing cam 95 positioned on the terminal end side of the former. The vertical groove portion 95*a* continues from the upper end to the vicinity of the lower end of the cassette mount 3, and the needle thread releasing cam 95 continues to the lower end of the vertical groove portion 95*a* through a taper portion 95*b*, and protrudes to the left side of the vertical groove portion 95*a*.

Figure 17:
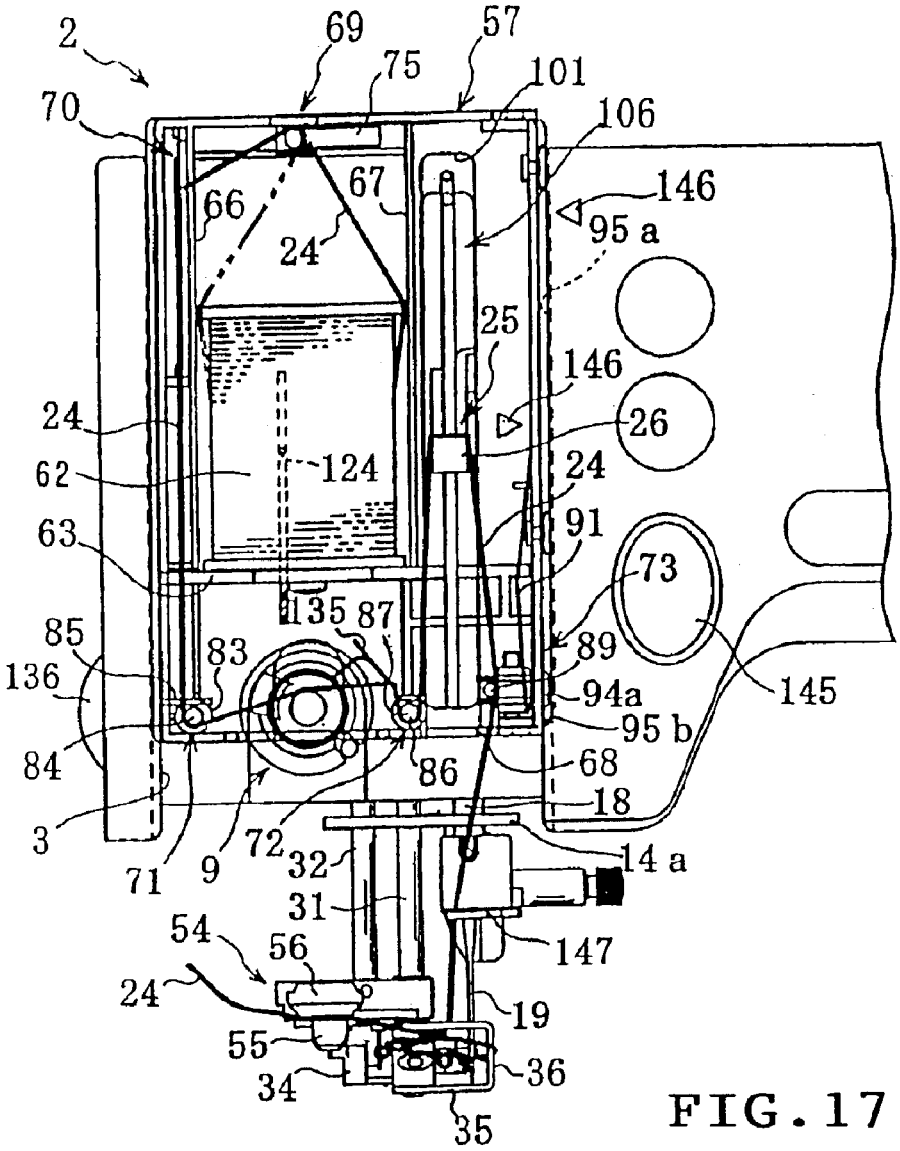
FIG. 17 is a front elevation of the needle thread cassette (in the state immediately before the mounting is completed) and an arm head.

As shown in FIG. 17 and FIG. 18, therefore, the control button 94 protruding from the right side face of the cassette body 60 moves along the groove portion 95*a* till immediately before the needle thread cassette 2 is completely mounted in the cassette mount 3. At this time, the second clamp portion 73 applies the passing resistance to the needle thread 24. When the needle thread cassette 57 is completely mounted in the cassette mount 3 so that the mounting is completed, the control button 94 comes into abutment against the needle thread releasing cam 95 and is pushed leftward. At this time, the second clamp portion 73 is released so that no passing resistance is applied to the needle thread 24.

Next, the thread take-up lever mechanism 8 will be described in detail.

As shown in FIG. 11 to FIG. 14, this thread take-up lever mechanism 8 is given such a specially devised structure as can thread the thread guard 26 with the needle thread 24 in association with the action to mount the needle thread cassette 2 in the cassette mount 3. This thread take-up lever mechanism 8 is exemplified by a cam type, but the following construction can likewise be applied to a link type thread take-up lever mechanism.

This thread take-up lever mechanism 8 is provided with the thread take-up lever 25 which is driven through the thread take-up lever crank 20 by the driving force of the spindle, and the thread guide 106A for forming a thread guide clearance 108 extending in a curved shape along the whole length of the moving locus of the thread guard 26 of the thread take-up lever 25. The thread take-up lever mechanism 8 can introduce the needle thread 24 from above into the thread guide clearance 108 thereby to thread the thread guard 26 with the needle thread 24.

The thread guide 106A is provided with a pair of thread guide members 106, which extend in a curved shape along the whole length of the moving locus of the leading end portion (or the thread guard 26) of the thread take-up lever 25 and which are longitudinally spaced from each other through the thread guide clearance 108. The paired thread guide members 106 are made of a single wire material (of a metal or a synthetic resin) continued at the lower end portion. The upper end portion of the thread guide member 106 on the rear side extends horizontally backward and is so supported on the top frame of the sewing machine frame as to turn through a hinge member 107 so that the lower end portion of the thread guide 106A is left as a free end. The upper end portion of the thread guide member 106 on the front side is bent forward to form an inlet port 108*a* for introducing the needle thread 24 from above into the thread guide clearance 108. Here, the thread guide 106A and the thread guard 26 of the thread take-up lever 25 protrude from the opening of the rear wall of the cassette mount 3 into the cassette mount 3.

The thread take-up lever 25 is equipped at its leading end side with a guide portion 25*a* having a U-shaped, as viewed in a top plan, which is formed by folding back the leading end portion of a predetermined length. The paired thread guide members 106 insert the U-shaped guide portion 25*a* slidably relative to each other. When the U-shaped guide portion 25*a* vertically reciprocates, the paired thread guide members 106 are guided, while being turned at their upper portions, by the U-shaped guide portion 25*a* so that their sliding resistance to the U-shaped guide portion 25*a* is so low as to generate no substantial noise. In the portion, as corresponds to the clearance (i.e., the thread guide clearance 108) between the paired thread guide members 106, of the U-shaped guide portion 25*a*, there is formed the thread guard 26, which has a threading U-shaped recess formed in its upper face for threading the needle thread 24 from above.

When the needle thread cassette 2 is mounted vertically from above with the axis of the thread bobbin 62 being generally in parallel with the reciprocating direction of the thread guard 26 of the thread take-up lever 25, therefore, the needle thread 24 between the third guide portion 72 and the second clamp portion 73 of the needle thread cassette 57 can be introduced automatically, in association with the mounting action, from the inlet port 108*a* into the thread guide clearance 108 and can be easily engaged with the thread guard 26 of the thread take-up lever 25. Here, the thread guide 106A need not be made of the wire material but may be constructed of a sheet material made of a metal or a synthetic resin.

Here will be described the transmission mechanism 115 for transmitting the actions of the needle thread cassette 2 to the automatic threading mechanism 10. As shown in FIG. 5 to FIG. 8, this transmission mechanism 115 transmits the actions of the needle thread cassette 2 to the automatic threading mechanism 10 through a threading slider actuating mechanism 116, and is provided with an engaging mechanism 117 for releasing when engaged with the threading positioning member 52. This threading slider actuating mechanism 116 is constructed to include: a threading slider actuating shaft 118 (as will be called the "shaft 118"); a threading slider actuating member 119; a threading slider actuating lever 120 (as will be called the "lever 120"); a threading slider actuating pawl 121 (as will be called the "actuating pawl 121"); a threading slider actuating pawl spring 122 (as will be called the "torsion spring 122"); and a threading slider actuating stopper 123 (as will be called the "stopper 123").

Figure 4:
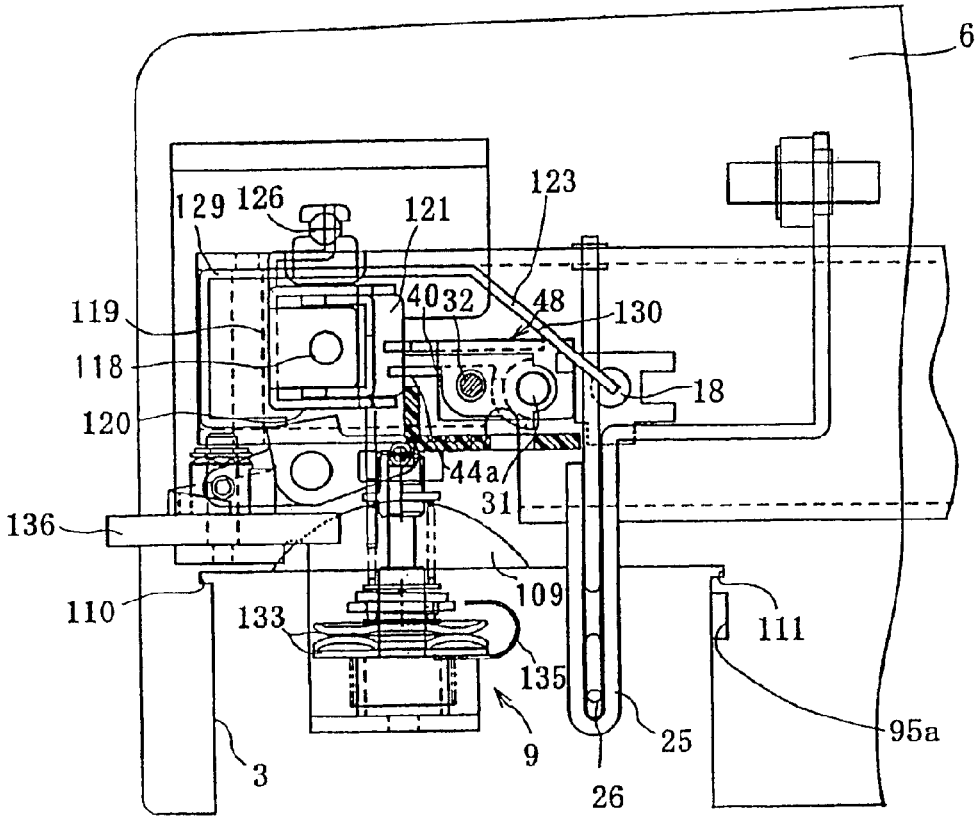
FIG. 4 is a top plan section showing an internal structure and so on near the cassette mounting portion.
Figure 10:
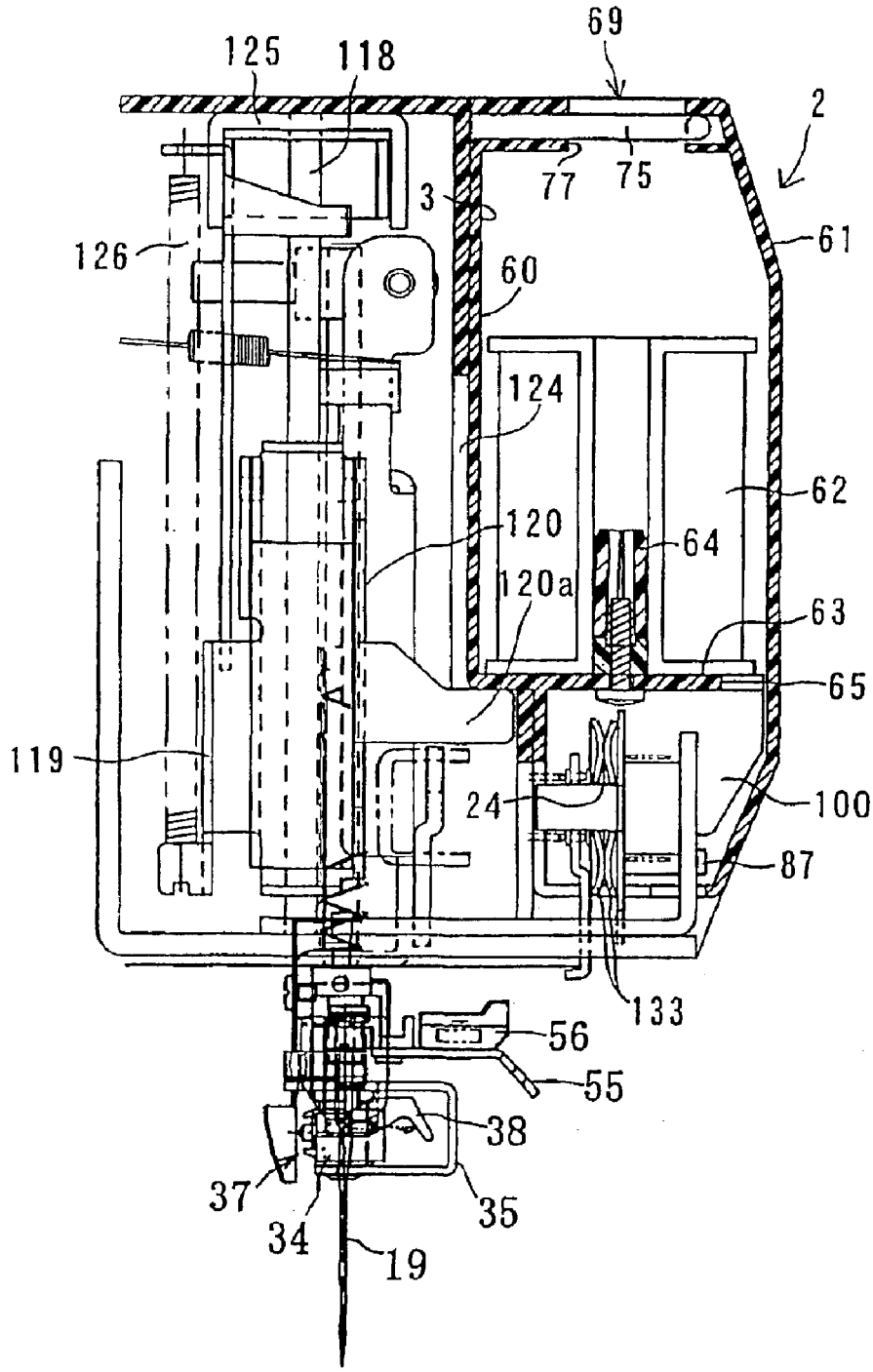
Figure 11:
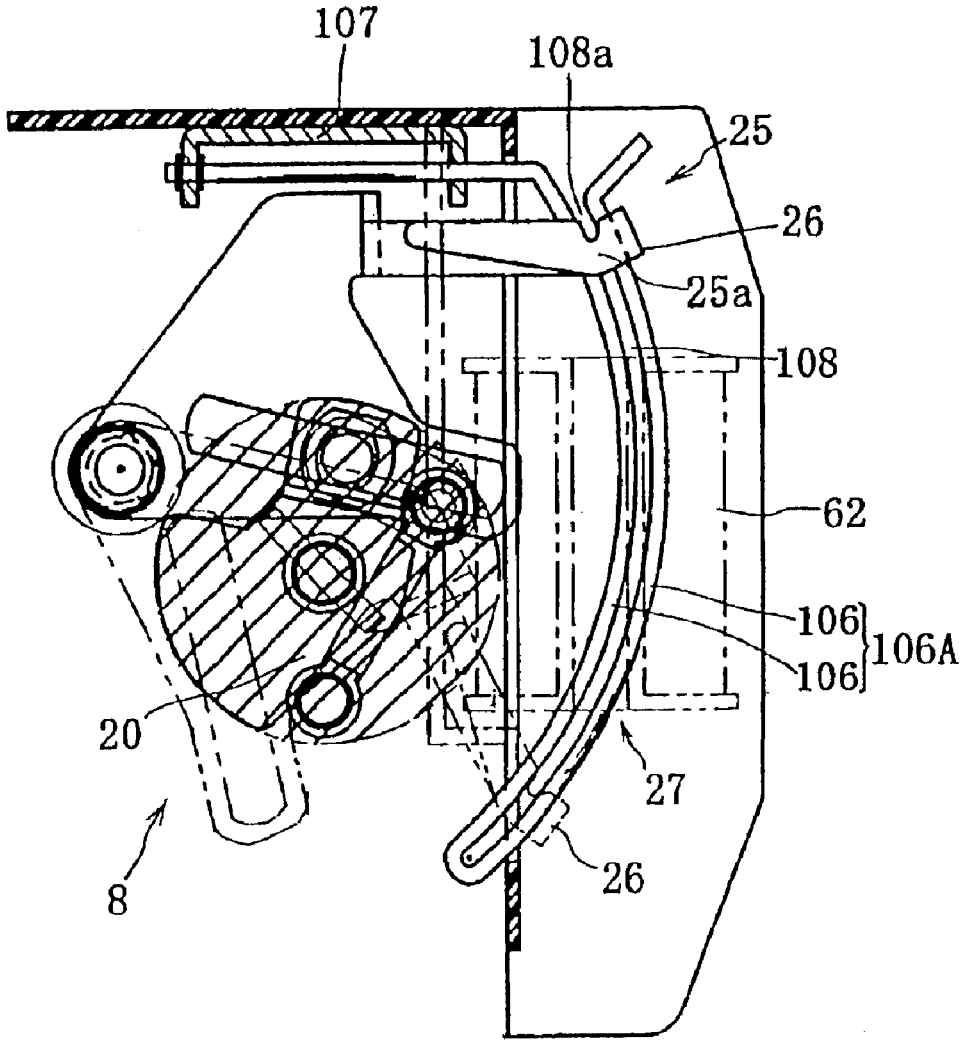
FIG. 11 is a longitudinally sectional side elevation of an essential portion showing a thread take-up lever mechanism and the cassette mounting portion.
Figure 12:
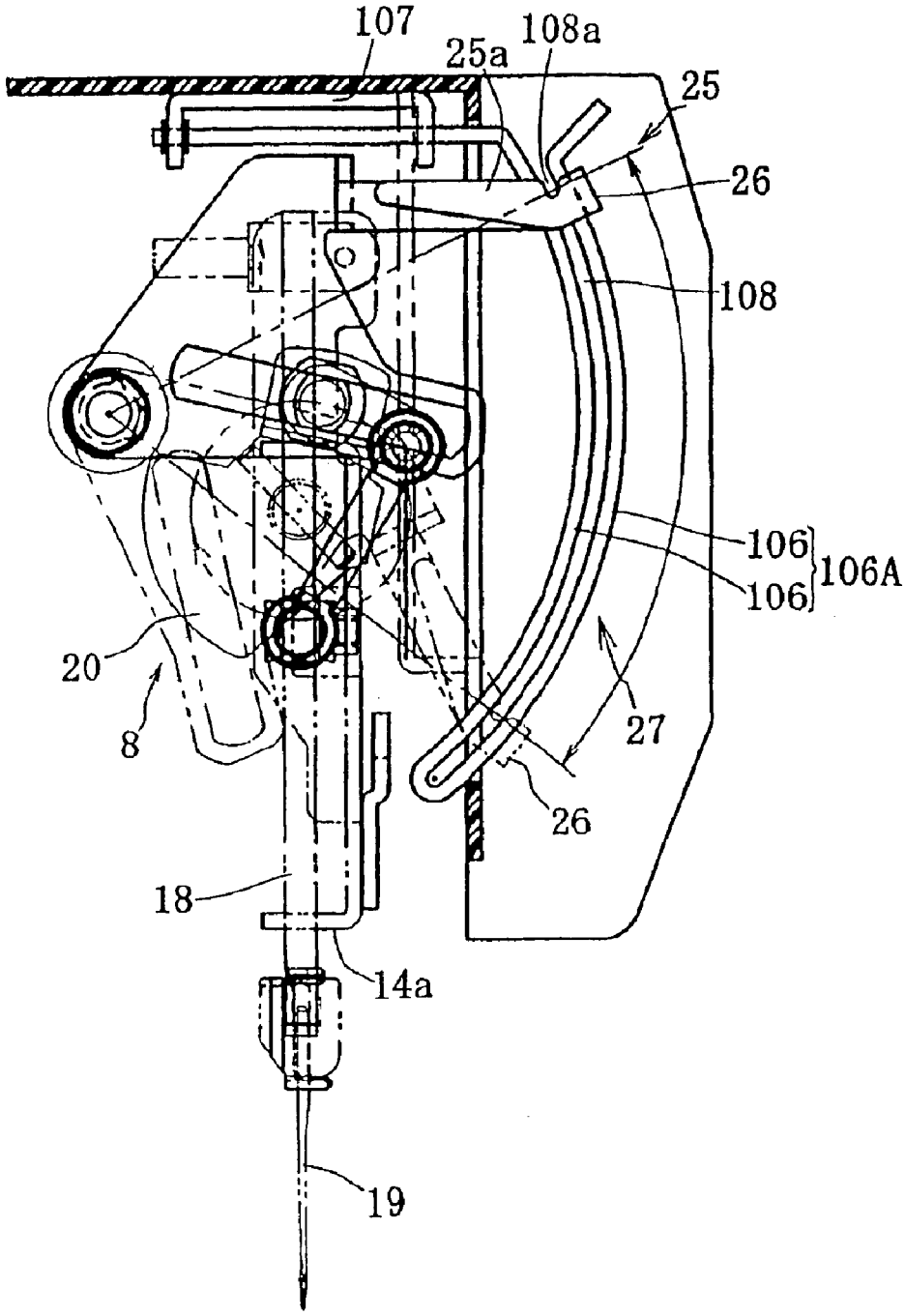
FIG. 12 is a longitudinally sectional side elevation of an essential portion and shows the moving range of thread guard of the thread take-up lever.

In the arm 6 near the cassette mount 3, as shown in FIG. 4, FIG. 5 and FIG. 10, there is vertically supported the shaft 118, on which the slider actuating member 119 having a general C-shape, as viewed in a side elevation, is vertically movably supported. On the threading slider actuating member 119, there is fixed the lever 120 having a C-shape, as viewed in a top plan. A plate-shaped lever portion 120*a* is so disposed at a substantially intermediate portion of the right end of the front plate portion of the lever 120 as to protrude forward. The leading end portion of the lever portion 120*a* is formed to protrude by a predetermined length from the inside of the arm 6 through the receiving portion 109 of the cassette mount 3. From the substantially intermediate portion to the lower end of the receiving portion 109, there is formed a slit 124, along which the lever portion 120*a* can move up and down.

A bracket 125 is fixed on the top plate near the upper end of the shaft 118, and a tension coil spring 126 is interposed on the back side of the shaft 118 over between the stopper 123 and the lever 120 thereby to bias the lever 120 (i.e., the lever portion 120*a*) upward. In order to retain the completely mounted state (or the sewing position) of the needle thread cassette 2, the frictional resistance to act between the control button 94*a* and the cam 95 is made higher than the biasing force of the tension coil spring 126.

Here will be described the engaging mechanism 117. At the right end upper portion of the lever 120, as shown in FIG. 4 to FIG. 8, there is hinged the actuating pawl 121. This actuating pawl 121 is constructed to rock over a lock position, in which its lower end portion can engage with the pawl portion 44*a* of the threading slider pawl 44, and a release position, in which the actuating pawl 121 is released from the engagement with the pawl portion 44*a*. Around a hinge pin 127, however, there is mounted the torsion spring 122 to act between the threading slider actuating member 119 and the actuating pawl 121, thereby to bias the actuating pawl 121 to the lock position side.

The lower end portion of the actuating pawl 121 is constructed to come into and out of abutment against the offset member cam portion 53. When the threading slider actuating member 119 is pushed down in the lock position, the lower end portion of the actuating pawl 121 abuts against the slope portion 53*a* of the offset member cam portion 53 and moves leftward along the slope portion 53*a*. In the state where the right end portion of the upper support portion 49 of the offset member 48 is abutting against the threading positioning member 52 from above, as shown in FIG. 6, the actuating pawl 121 is switched to the release position so that the engaging mechanism 117 is released. When the actuating pawl 121 is switched to the release position, the threading slider 40 and the offset member 48 are returned upward from the lower limit position, as shown in FIG. 6, by the biasing forces of the compression coil springs 46 and 47.

Here will be described the stopper 123. On the left end portion of the bracket 125, as shown in FIG. 4 to FIG. 8, there is longitudinally supported a stopper pin 128, to which the stopper 123 having a general L-shape, as viewed in a side elevation, is hinged. This stopper 123 is provided with: a vertical portion 129 extending generally vertically downward from the stopper pin 128; a horizontal portion 130 extending generally horizontally rightward from the stopper pin 128 to the top position of the needle bar 18; and the aforementioned tension coil spring 126 (as referred to FIG. 10) for biasing those vertical portion 129 and horizontal portion 130 clockwise in FIG. 8. At the lower end of the vertical portion 129, there is formed a slope portion 131, which is sloped the more leftward as it goes the more downward.

At the left end portion in which the slope portion 131 and the vertical portion 129 intersect, there is formed a stopper portion 132 (corresponding to a step portion). This stopper portion 132 can be engaged from above with a stopper engaging portion 119*a*, which is formed at the lower end portion of the threading slider actuating member 119. In case the upper end of the needle bar 18, i.e., the stopper 123 is within a proper range from 500A to 500B (as referred to FIG. 8), the stopper engaging portion 119*a* comes into contact with the slope portion 131 of the stopper 123 when the threading slider actuating member 119 is moved downward from the upper limit position, as shown in FIG. 5, by the needle thread cassette 2. After this, a guide wall 119*b* of the threading slider actuating member 119 slides with respect to the left end of the slope portion 131.

Figure 6:
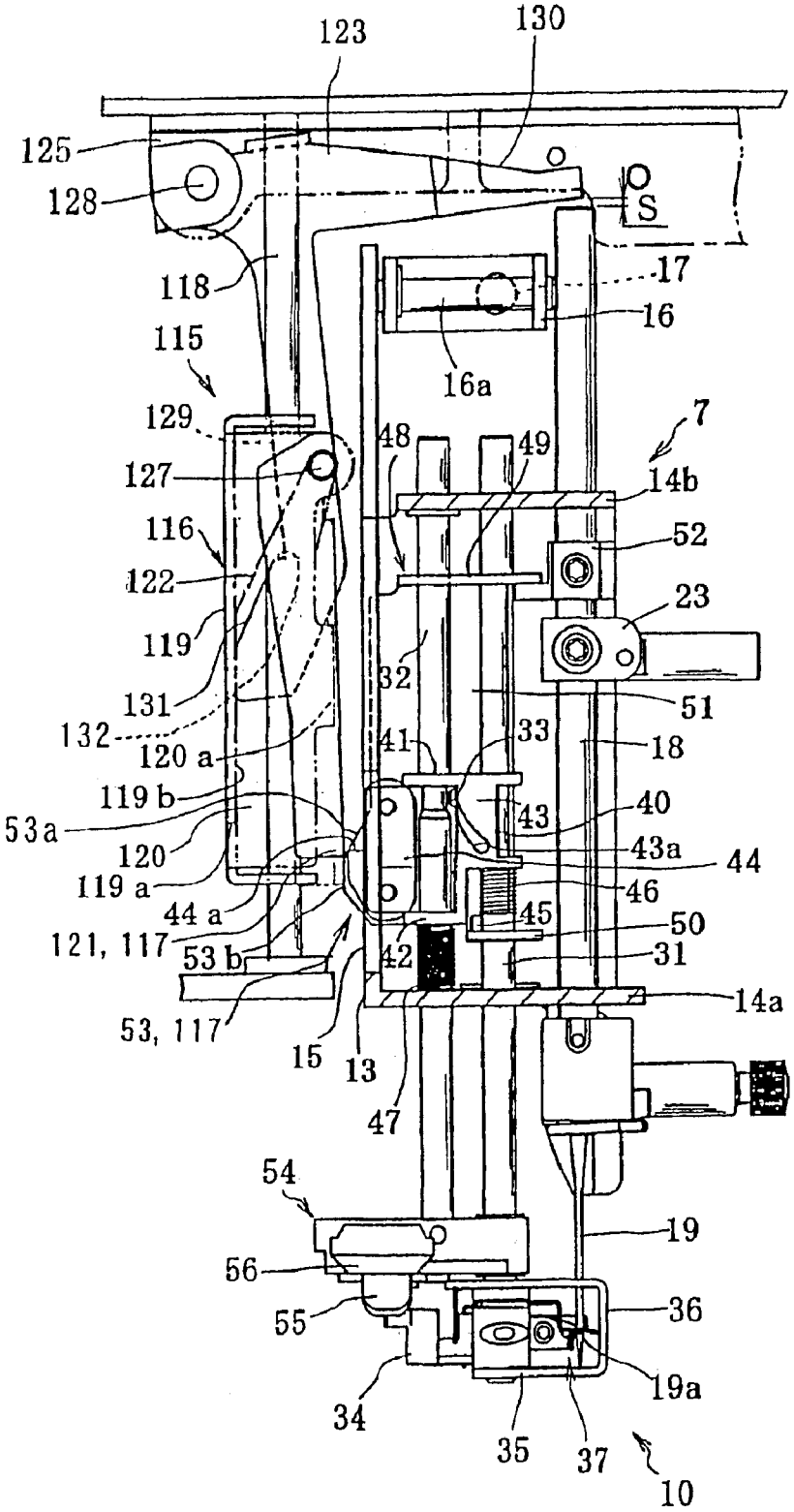
FIG. 6 a view corresponding to FIG. 5 and shows a state immediately before the threading.

As the threading slider actuating member 119 moves downward, the stopper 123 rocks counterclockwise against the biasing force of the tension coil spring 126 so that the threading sliding actuating member 119 can move from the upper limit position to the lower limit position, as shown in FIG. 6. In case the upper end of the needle bar 18 is outside of the proper range, the stopper 123 rocks further clockwise from the position 500B (as referred to FIG. 8). Even if the threading slider actuating member 119 in this state is moved downward, the stopper engaging portion 119*a* engages with the stopper portion 132. Therefore, the threading slider actuating member 119 cannot move to inhibit the threading.

Figure 7:
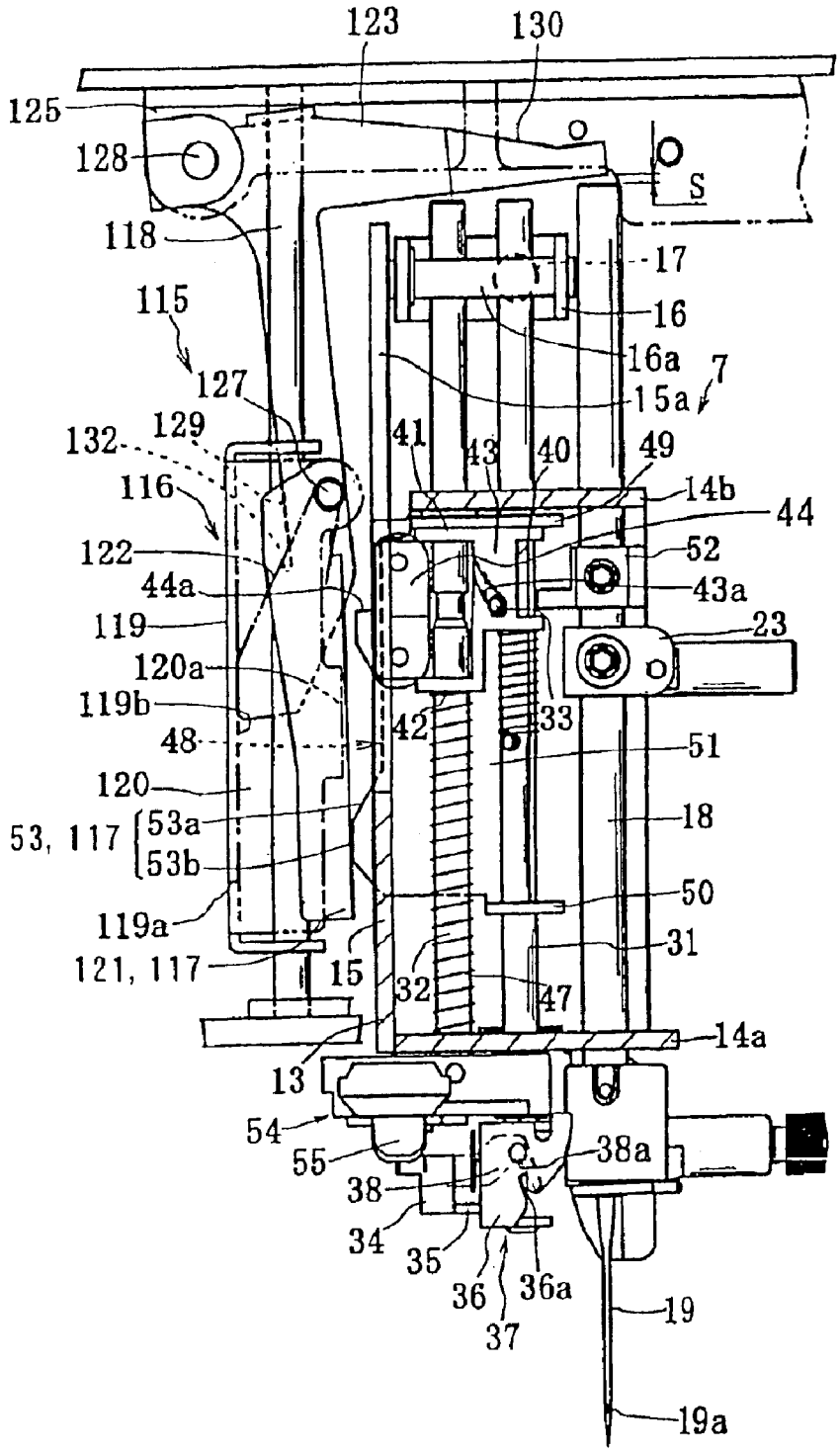
FIG. 7 is a view corresponding to FIG. 5 and shows the relations between a needle bar and a stopper.
Figure 8:
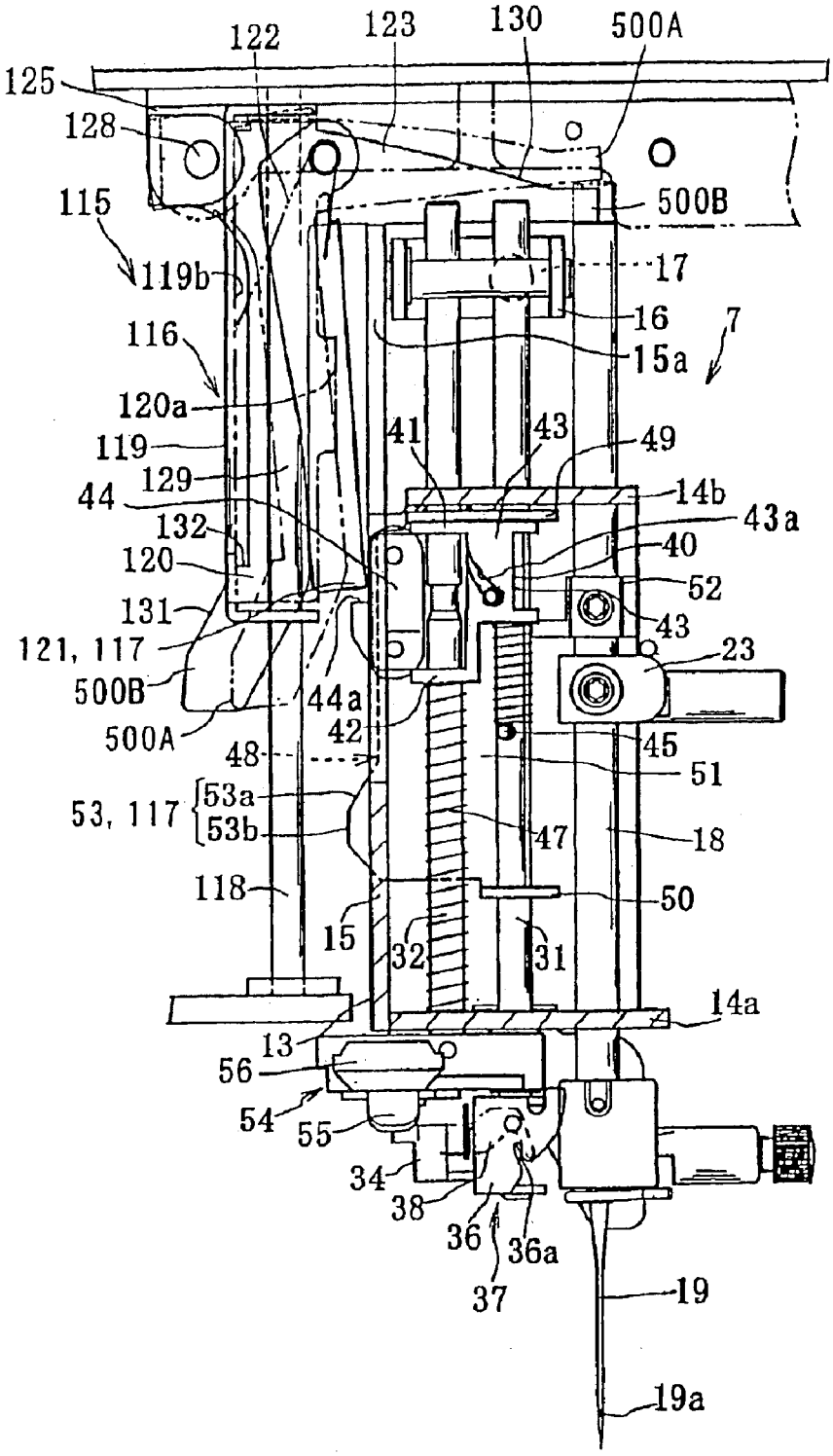
FIG. 8 is a view corresponding to FIG. 5 and explains a proper height range of the needle bar.

As shown in FIG. 7, the guide wall 119*b* of the threading slider actuating member 119 slides on the slope portion 131 of the stopper 123. As a result, the height position of the horizontal portion 130 of the stopper 123 is regulated to form a small clearance S between the upper end of the needle bar 18 at the highest position and the horizontal portion 130 thereby to prevent the knocking sound between the needle bar 18 and the stopper 123.

Here will be described the thread tension regulator 9 and the interlocking mechanism 134 for the thread tension regulator 9.

The interlocking mechanism 134 is a mechanism for opening a pair of thread tension discs 133 by the needle thread cassette 2 in the course of the action to mount the needle thread cassette 2 in the cassette mount 3 and for closing the thread tension discs 133 at the time of completing the mounting operation.

In the state where the needle thread cassette 2 is mounted in the cassette mount 3, as shown in FIG. 4, FIG. 10, FIG. 16 and FIG. 37 to FIG. 45, the thread tension regulator 9 penetrates into the thread tension regulator housing portion 57*c* in the cassette case 57. The thread tension regulator 9 has a general structure including: the paired thread tension discs 133; pin members for supporting those thread tension discs 133; an actuating plate 139 located on the back side of the rear thread tension disc 133; a spring member for elastically biasing the rear thread tension disc 133 and the actuating plate 139 forward; a thread tension spring 135 for supporting the needle thread 24 elastically near the thread tension discs 133; and a thread tension dial 136 for adjusting the spring force.

As shown in FIG. 37 to FIG. 45, the interlocking mechanism 134 is provided with a cam portion 137 formed on the rear side face of the needle thread cassette 57, a cam follower member 138 having a vertical lever shape, and a turning arm 151. The cam portion 137 like a ridge slightly protruding backward is formed on the upper half of the left end side of the cassette body 60. At the upper portion of the frame 140 for supporting the thread tension regulator 9, there is formed a bracket 141, on which the longitudinal intermediate portion of the cam follower member 138 is turnably supported by a transverse horizontal pin. This cam follower member 138 is biased clockwise in FIG. 41 by a torsion spring 144.

A roller 142 is freely rotatably hinged to the upper end portion of the cam follower member 138.

At the left side portion of the rear wall of the cassette mount 3, there is formed a slit 143 (as referred to FIG. 14)

for protruding the cam portion 137 of the needle thread cassette 57 backward. The roller 142 can abut against the cam portion 137 which is protruded backward from that slit 143. The right end portion of the turning arm 151 is so connected to the lower portion of a base plate 155 through a vertical pin as to turn horizontally, and the lower end portion of the cam follower member 138 abuts against the rear face of the left end portion of the turning arm 151, so that the turning arm 151 can abut at its protrusion 151*a* against the actuating plate 139.

By setting the shape of the cam portion 137 and the position of the roller 142 properly, the thread tension discs 133 are opened in the mounting course of the needle thread cassette 57 thereby to thread the paired thread tension discs 133 and the thread tension spring 135. After this, the thread tension discs 133 are closed when the needle thread cassette 57 is completely mounted. When the needle thread cassette 57 is mounted in the cassette mount 3 so that it reaches a predetermined distance above the thread tension regulator 9, more specifically, the roller 142 rides over the cam portion 137 so that the cam follower member 138 turns counterclockwise in FIG. 41 thereby to open the thread tension discs 133 with the turning arm 151 and the actuating plate 139.

When the needle thread cassette 57 moves down in this state, the needle thread 24 between the second and third guide portions 71 and 72 is engaged between the paired thread tension discs 133. After this, the cam portion 137 becomes lower and does not push the roller 142 backward, when the needle thread cassette 57 comes into the completely mounted state. Therefore, the turning arm 151 rotationally returns backward, and the actuating plate 139 returns backward, so that the paired thread tension discs 133 are closed. Here, the aforementioned actions of the interlocking mechanism 134 at the time of mounting the needle thread cassette 57 occur irrespective of the position (e.g., the lower turned position or the upper turned position) of the foot lifting lever 29.

Next, the mechanism for opening the paired thread tension discs 133 by the action of the foot lifting lever 29 as in the ordinary sewing machine is well known in the art so that it will be briefly described. As shown in FIG. 37 to FIG. 45, the upper end portion of the foot lifting lever 29 is turnably hinged to the machine frame, and the upper end portion of an engaging arm 152 engaging with a cam portion 29*a* of that foot lifting lever 29 is also turnably hinged to the machine frame. The engaging arm 152 is connected to the rear end portion of a horizontal triangular plate 154 by a connecting rod 153. The triangular plate 154 is arranged on the lower side of the lower plate portion of the base plate 155 on the machine frame side. The left end portion of the front end portion of the triangular plate 154 is turnably hinged to the lower plate portion of the base plate 155 through a vertical pin, and the right end portion of the front end portion of the triangular plate 154 abuts against the actuating plate 139.

When the foot lifting lever 29 takes its lower turning position, therefore, the connecting rod 153 is not pulled rightward, so that the triangular plate 154 does not turn to keep the thread tension discs 133 in their closed state. When the foot lifting lever 29 is switched to the upper turning position, the connecting rod 153 is pulled rightward, so that the triangular plate 154 turns to bring the thread tension discs 133 into the open state.

Here will be described the actions of the aforementioned sewing machine 1 and the actions of the needle thread cassette 2.

In the state where the needle thread cassette 2 is not mounted in the cassette mount 3, as shown in FIG. 14 and FIG. 23 to FIG. 27, the openable cover 61 of the needle thread cassette 2 is opened, and the thread bobbin 62 is mounted in the thread bobbin retaining portion 58. Next, the needle thread 24, as pulled out from the thread bobbin 62, is engaged with the first guide portion 69 and with the thread guide portion 80*a* of the first clamp portion 70, and is pressed by the leaf spring 81. Next, the needle thread 24 is engaged sequentially with the second and third guide portions 71 and 72 and is clamped between the guide pin 89 of the second clamp portion 73 and the thread retaining plate 90.

Next, the control button 94*a* is pressed with the finger of the operator against the biasing force of the leaf spring member 91 to bring the guide pin 89 apart from the thread retaining plate 90. After this, the needle thread 24 is pulled out by a predetermined length to the outside, and the control button 94*a* is then released. The needle thread 24 is clamped by the second clamp portion 73, and the openable cover 61 is closed. In order to make the threading procedures of the needle thread cassette 2 easy, marks of threading orders may be adhered to the individual vicinities of the first guide portion 69, the first clamp portion 70, the second and third guide portions 71 and 72 and the second clamp portion 73 so that the threading may be done in the mark orders.

Figure 13:
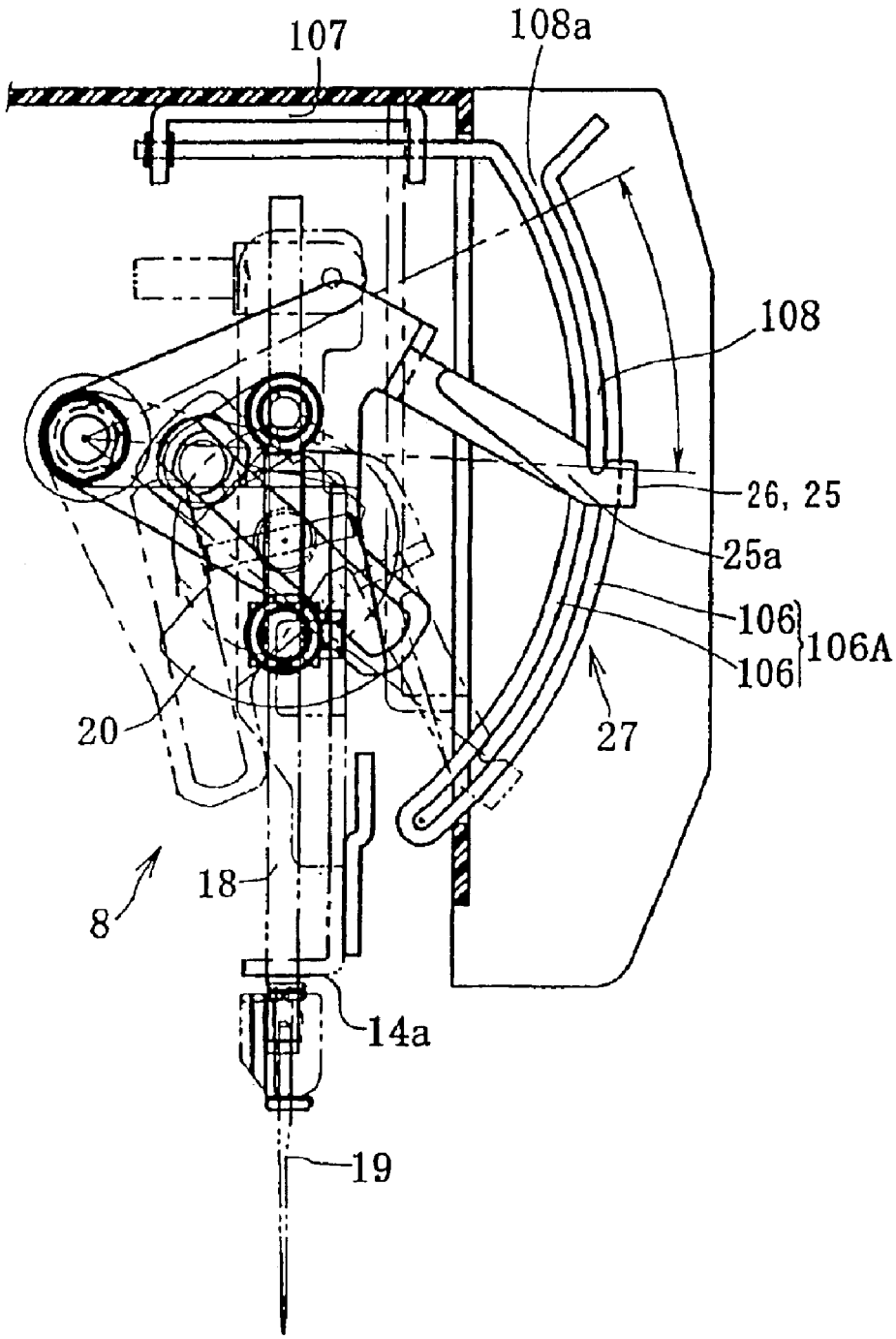
FIG. 13 is a view corresponding to FIG. 12 and shows the threading range of the thread guard.

When the sewing machine 1 is in the sewing interrupted state, on the other hand, the needle bar 18 is normally stopped at its top stop position and the thread guard 26 of the tread take-up lever 25 stops at the substantially intermediate position on the thread-tightening side shown in FIG. 13. In this state, the needle thread cassette 2 is mounted from above in the cassette mount 3. The cassette mount 3 is opened both upward and downward so that the needle thread 24, as pulled out by about 20 cm from the thread exit 68 of the needle thread cassette 2, depends vertically downward of the cassette mount 3. At the time of starting the sewing operation, the thread guard 26 of the thread take-up lever 25 moves up from the substantially intermediate position on the aforementioned thread-tightening side and then moves down.

Figure 15:
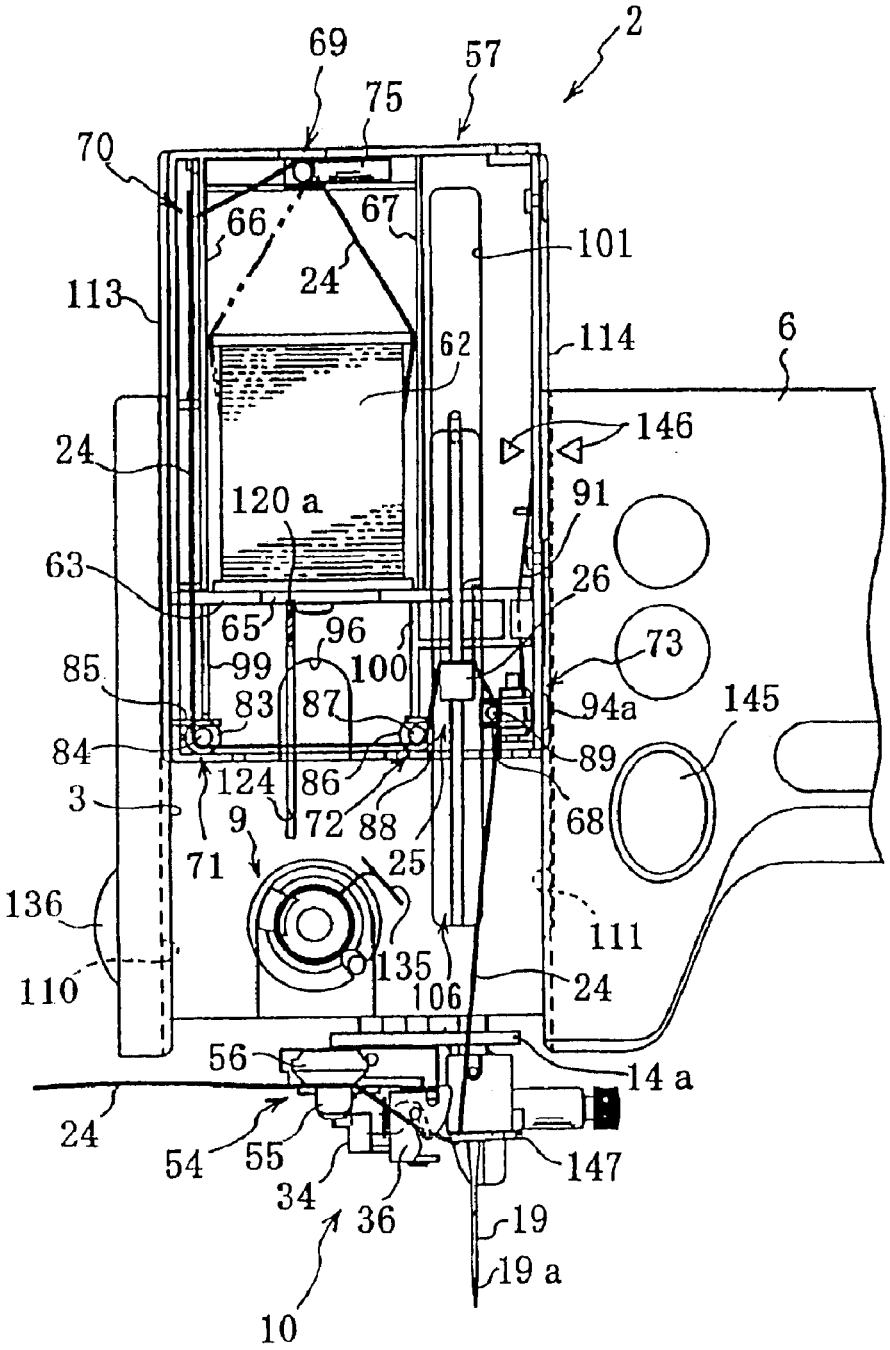
FIG. 15 is a front elevation of the needle thread cassette (in the state of being mounted) and the cassette mounting portion.
Figure 16:
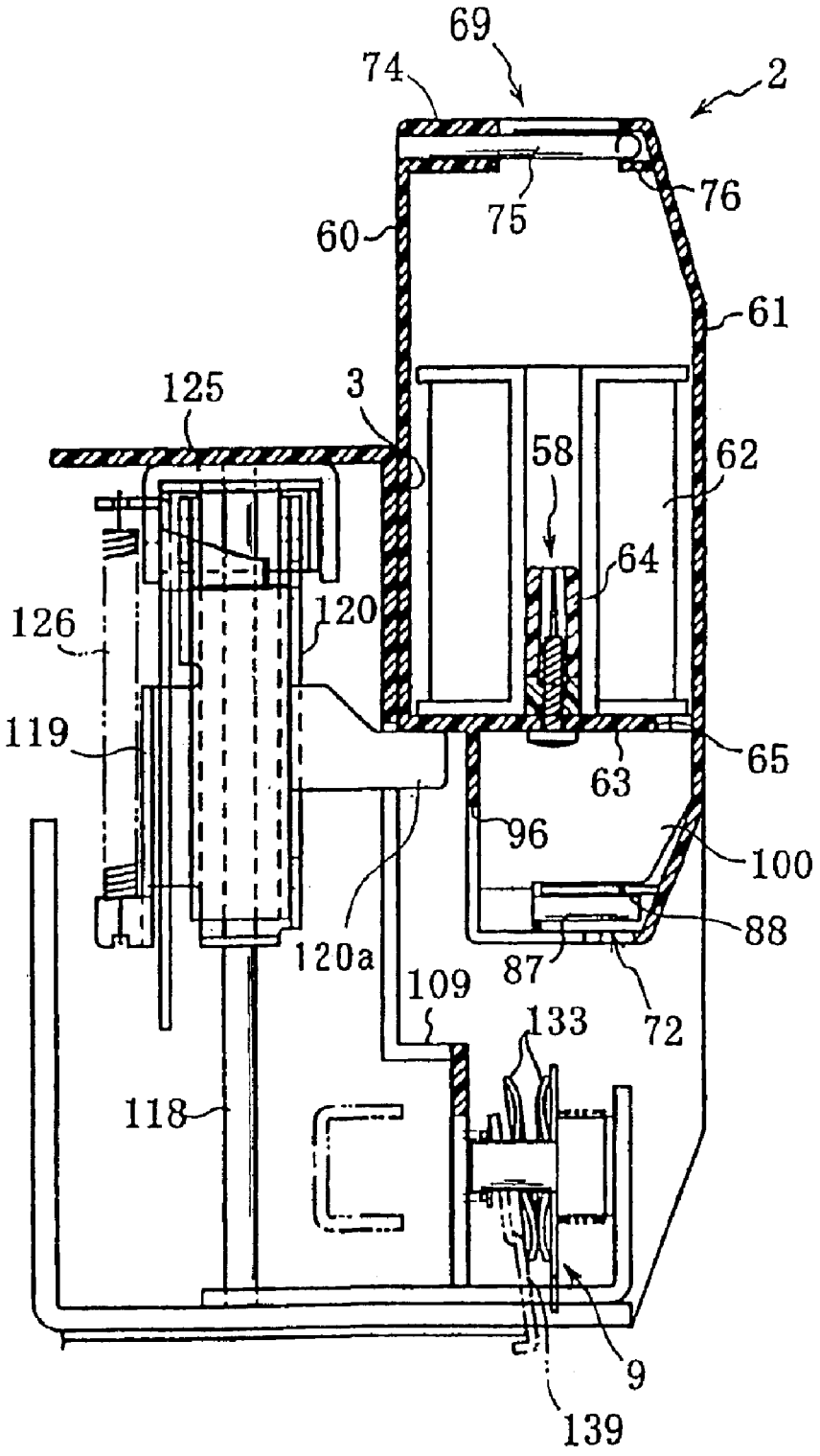
FIG. 16 is a longitudinally sectional side elevation of the needle thread cassette (in the state of being mounted) and the cassette mounting portion.

In the course of mounting the needle thread cassette 2, as shown in FIG. 15 and FIG. 16, the needle thread cassette 2 is once stopped with its engaging portion 112 abutting against the lever portion 120*a*. At this time, the needle thread 24 between the third guide portion 72 and the second clamp portion 73 is introduced into the thread guide clearance 108 and engaged with the thread guard 26 of the thread take-up lever 25, as shown in FIG. 15. In this case, the second clamp portion 73 applies a higher passing resistance than that of the first clamp portion 70 so that the needle thread 24 is fed out by a necessary amount from the thread bobbin 62 without being pulled back into the cassette 2. Here, a pair of notch marks 146 for confirming the travel stop position are formed on the needle thread cassette 2 and the sewing machine 1.

Next, the needle thread 24 depending downward from the thread exit 68 of the needle thread cassette 2 is engaged with the needle bar thread hook 147 and the thread guide 36*a* in the recited order and is clamped under a low pressure between the support plate 55 and the thread guide disc 56. After this, the thread end is cut with the not-shown thread trimming blade. Next, the needle thread cassette 2 is pressed downward against the biasing force of the tension coil spring 126, as shown in FIG. 17. Then, the action of the needle thread cassette 2 is transmitted through the transmission mechanism 115 to the automatic threading mechanism 10 so that the needle thread 24 is threaded into the needle eye 19*a*. The engaging portion 112 as the threading action portion of the needle thread cassette 2 moves the lever portion 120*a* at the leading end of the lever 120 downward so that the movement of the needle thread cassette 2 is transmitted to the transmission mechanism 115. In parallel with this, the needle thread cassette 57 moves downward relative to the thread take-up lever 25 so that the thread passage between the third thread guide portion 72 and the second clamp portion 73 is elongated to feed out the needle thread 24 from the thread bobbin 62.

At this time, the thread tension discs 133 of the thread tension regulator 9 are opened by the interlocking mechanism 134, as has been described hereinbefore, so that the needle thread 24 between the second and third guide portions 71 and 72 is engaged with the clearance between the thread tension discs 133 and with the thread tension spring 135. By the first clamp portion 70 and the second clamp portion 73, the needle thread 24 inbetween is subjected to a constant tension so that it is engaged with the thread take-up lever 25, the thread tension discs 133 and the thread tension spring 135 without fail. The second clamp portion 73 applies a higher passing resistance than that of the first clamp portion 70 to the needle thread 24 so that the needle thread 24 in an amount necessary for the threading is reliably fed out from the thread bobbin 62, as described above, without being fed back through the second clamp portion 73 and returned into the cassette 2. Moreover, the needle thread 24 from the first clamp portion 70 to the second clamp portion 73 does not become slack so that it is neither twisted nor interlaced.

In the state where the needle thread cassette 2 is completely mounted in the cassette mount 3 (that is, where the engaging portion 112 engages from above with the receiving portion 109), as shown in FIG. 19 and FIG. 20, the thread tension discs 133 are closed by the interlocking mechanism 134, and the threading slider actuating member 119 is retained at the lowermost position by the needle thread cassette 2. In this state, the threading pin 31 and the slider guide pin 32 are returned upward to thread the needle eye 19*a* with the needle thread 24. As shown in FIG. 20, moreover, the control button 94*a* is pushed leftward by the thread releasing cam 95, and the guide pin 89 leaves the thread retaining plate 90 to release the second clamp portion 73, so that the needle thread 24 is released for a sewing state.

In the state where the needle thread cassette 57 is completely mounted, moreover, the paired thread tension discs 133 may be closed, and the second clamp portion 73 may be released. Even in this case, the needle thread 24 is clamped by the first clamp portion 70 to apply the passing resistance to the needle thread 24, so that the needle thread 24 in the needle thread cassette 57 is neither twisted nor interlaced. As a result, the thread is hardly cut during the sewing operation by the interlace. With the needle thread cassette 2 being mounted in the cassette mount 3, the thread guide 106A and the thread guard 26 of the thread take-up lever 25 protrude into the needle thread cassette 57 so that the thread guard 26 of the thread take-up lever 25 can reciprocate generally vertically in the needle thread cassette 2.

Here in the thread tension regulator housing portion 57*c* of the cassette body 60, as shown in FIG. 19, an needle thread pressing member 180 (as indicated by a dotted line) including a thread guide portion notched downward may be disposed downstream of the thread tension regulator thereby to press and arrange the needle thread 24 extending downstream of the thread tension regulator 9, downward by the action of mounting the needle thread cassette 2 in the cassette mount 3. In this case, the portion of the needle thread 24 to contact with the pin member of the thread tension regulator 9 is increased to prevent the needle thread 24 from being suddenly disengaged and to increase the take-up amount of the needle thread 24 by the thread tension spring 135. When the needle thread cassette 2 is to be removed, it can be easily released from the needle thread pressing member 180.

With the needle thread cassette 57 being mounted in the cassette mount 3, as has been described hereinbefore, the sewing operation can be performed while feeding the needle thread 24 to the thread bobbin 62. When the needle thread cassette 2 is demounted from the cassette mount 3 so as to change the color of the needle thread 24 or to supply the needle thread 24, the needle thread cassette 2 can be simply removed by pushing its lower end upward with the finger of the operator.

After this removal, the slack thread disengaged from the thread take-up lever 25 and the thread tension regulator 9 is left in the needle thread cassette 2. Therefore, the control button 94*a* is pressed with the finger to switch the second clamp portion 73 into the release state, and the slack thread in the needle thread cassette 2 is pulled out in that state and is wound on the outer circumference of the cassette. The end portion of the needle thread 24 is temporarily held on the thread holder 104 or the thread holder 104A. After this, the control button 94 is returned to bring the second clamp portion 73 into the closed state.

The sewing machine 1 and the needle thread cassette 2 according to the embodiment have the following effects.

1) The thread bobbin 62 is housed in the needle thread cassette 2, and the thread bobbin 62 can be exchanged by exchanging the needle thread cassette 2 so that the needle thread 24 can be easily exchanged. Especially in association with the mounting action of the needle thread cassette 2, the thread guard 26 of the thread take-up lever 25, the thread tension discs 133 of the thread tension regulator 9 and the thread tension spring 135 are automatically threaded so that the threading operation is remarkably simplified and can be efficiently performed. In association with the action of mounting the needle thread cassette 2, the automatic threading mechanism 10 is actuated to thread the needle eye 29*a* automatically so that the threading itself can be remarkably simplified to exchange the needle thread 24 quickly and efficiently.

In the aforementioned sewing machine disclosed in U.S. Pat. No. 3,749,039, the spindle is manually turned to hold the thread guard of the thread take-up lever at the lowermost position (or the thread loosening position), and the needle thread cassette is mounted in the cassette mount. In this state where the needle thread cassette is mounted in the cassette mount, the first and second resistance applying portions are released. When the thread take-up lever moves to the uppermost position (or the thread tightening position) at the sewing staring time, therefore, the needle thread is not always fed out from the thread bobbin, but the needle thread in the needle eye may be pulled to come out of the needle eye.

When the sewing machine is to be stopped, on the other hand, it is normally stopped with the needle bar being at the uppermost position. At this time, the thread take-up lever is at a midway position of the thread tightening operation near its uppermost position. In the sewing machine disclosed in the foregoing U.S. Pat. No. 3,749,039, the thread take-up lever has to be switched by the manual operation to the lowermost position when the needle thread cassette is to be mounted, so that the switching operation is troublesome.

In the sewing machine 1 and the needle thread cassette 2 according to the embodiment, on the contrary, the sewing operation is interrupted, and the needle bar 18 is stopped at the needle top position, and the thread guard 26 of the thread take-up lever 25 is stopped at the position of the thread tightening side. Without changing the position of the thread take-up lever 25, the needle thread cassette 2 can be mounted, and the thread guard 26 of the thread take-up lever 25 and the thread tension regulator 9 can be threaded to make the mounting of the needle thread cassette 2 and the threading operation remarkably simple and efficient. Moreover, the needle thread cassette 2 can be mounted in the cassette mount 3 by moving it linearly from above and can be removed by moving the mounted needle thread cassette 2 linearly upward. Therefore, the mounting/demounting operations of the needle thread cassette 2 are so simple that the needle thread cassette 2 can be quickly exchanged.

Moreover, the cassette case 57 of the needle thread cassette 2 is transparent so that the thread color of the internal thread bobbin 62 can be easily discriminated. It is, therefore, convenient to exchange the needle thread 24 or the needle thread cassette 2. The recess 65 is formed in the support wall 63 for supporting the thread bobbin 62 in the needle thread cassette 2 so that the thread bobbin 62 can be simply removed from the thread bobbin retaining portion 58 by pushing the lower end of the thread bobbin 62 with the finger of the operator in the recess 65.

2) The thread bobbin 62 is retained in the needle thread cassette 2 with its axis being vertical, and the needle thread 24 is fed out upward from the thread bobbin 62 and is guided through the thread passage 59 into the thread exit 68, so that the needle thread cassette 2 can be reduced in the transverse width. Alternatively, the axis of the thread bobbin 62 and the feed-out direction of the needle thread 24 from the thread bobbin 62 are generally parallel to the reciprocating direction of the thread guard 26 of the thread take-up lever 25 thereby to mount the needle thread cassette 2 in the cassette mount 3. Therefore, it is possible to reduce the transverse width of the needle thread cassette 2 and the transverse width of the cassette mount 3.

Thus, the needle thread cassette 2 is small-sized to an elongated box shape having a small transverse width so that the cassette mount 3 can be arranged in the reciprocal travel region and its left side portion of the thread guard 26 of the thread take-up lever 25, that is, in the arm head. As a result, the cassette mount 3 can be formed in a region overlapping the reciprocal travel region of the thread guard 26 of the thread take-up lever 25 so that it is advantageous in space. Moreover, the cassette mount 3 can be arranged as backward as possible without any interference with the internal mechanism of the arm 6. As a result, the needle thread cassette 2 does not protrude, when mounted, from the front face of the arm 6, and the appearance of the arm 6 is not deteriorated while retaining the degree of freedom for the design of the front face of the arm 6.

3) The first clamp portion 70 for applying the passing resistance always to the needle thread 24 is disposed upstream of the thread passage 59 in the needle thread cassette 2, and the needle thread 24 between the first clamp portion 70 and the thread tension regulator 9 is kept tense with the needle thread cassette 24 being mounted. Therefore, it is possible to prevent the thread from being twisted or interlaced and to prevent the thread from being broken or frayed due to the interlace during the sewing operation.

Moreover, the second clamp portion 73 is disposed near the thread exit 68 to apply the passing resistance to the needle thread 24 before the needle thread cassette 2 is mounted or completely mounted. The second clamp portion 73 applies a higher passing resistance than that of the first clamp portion 70 so that the needle thread 24 is not accidentally fed out while being handled. When the thread guard 26 of the thread take-up lever 25 and the thread tension regulator 9 are threaded at the time of mounting the needle thread cassette 2, moreover, the needle thread can be fed out without fail from the thread bobbin 62.

With the needle thread cassette 2 being not mounted, moreover, the control button 94*a* is operated with the finger of the operator so that the second clamp portion 73 can be released to feed out the needle thread 24 freely.

After the needle thread cassette 2 is completely mounted, the control button 94*a* is pressed by the needle thread releasing cam 95 to switch the second clamp portion 73 into the released state. During the sewing operation, therefore, the passing resistance of the second clamp portion 73 does not act on the needle thread 24 to smoothen the feed-out of the needle thread 24.

When the needle thread cassette 2 is demounted from the cassette mount 3, the needle thread 24 extending to the outside of the cassette case 57 can be wound on the outer face of the cassette case 57 and its end portion can be remarkably conveniently held on the thread holder 104 or 104A.

4) On the top of the needle thread cassette 2, there are disposed the first guide portion 69, the longitudinally long openings 77 and 78 and the thread guide portion of the guide pin 75 confronting them in parallel. Therefore, the needle thread 24 can be freely moved along the guide pin 75 and can be smoothly fed out from the thread bobbin 62 without any resistance in a manner to draw an arc. In addition, the needle thread from the thread bobbin arranged outside of the needle thread cassette 2 can be introduced from the openings 77 and 78 into the needle thread cassette 2 and can be guided for the sewing operation from the inside thread passage 59 to the thread exit 68. When the needle 19 is replaced by two needles for the sewing operation with two needle threads, therefore, the needle threads can be fed for the sewing operations from the thread bobbin 62 in the needle thread cassette 2 and from the thread bobbin retained in the thread bobbin retaining portion at the top of the arm 6 outside of the needle thread cassette 2.

5) There is provided the interlocking mechanism 134 for releasing the thread tension regulator 9 in association with the mounting action of the needle thread cassette 2 and for closing the thread tension discs 133 after the needle thread cassette 2 is mounted. Therefore, the thread tension regulator 9 can be threaded in association with the action of mounting the needle thread cassette 2, as described hereinbefore. Here, the thread tension regulator 9 is arranged on the lower end side of the cassette mount 3. Therefore, it is especially advantageous to thread the thread tension regulator 9 in association with the mounting action to mount the needle thread cassette 2 from above in the cassette mount 3.

6) The thread take-up lever mechanism 8 has such an especial structure as to thread the thread guard 26 in association with the action of mounting the needle thread cassette 2. Specifically, the thread guide 106A is provided for forming the curved thread guide clearance 108 extending throughout the length of the moving locus of the thread guard 26 of the thread take-up lever 25, so that the needle thread 24 can be introduced from the inlet port 108*a* at the upper end of the thread guide clearance 108 and can be engaged with the thread guard 26. Therefore, the thread inlet 108*a* is so positioned as not to retract from the moving locus of the thread guard 26. With the thread guard 26 of the thread take-up lever 25 being stopped in the position (corresponding to the needle top stop position of the needle bar 18) on the aforementioned thread tightening side, therefore, the thread guard 26 can be threaded in association with the action to mount the needle thread cassette 2 in the cassette mount 3.

Moreover, the thread guide clearance 108 extends throughout the length of the moving locus of the thread guard 26, and the paired thread guide members 106 composing the thread guide 106A are made so slidable relative to the U-shaped guide portion 25*a* of the thread take-up lever 25. Even if the thread take-up lever 25 is vertically reciprocated at the sewing time, therefore, the needle thread 24 is so guided by the thread guide members 106 that it does not come out of the thread guard 26.

Moreover, the thread guide member 106 on the back side is turnably hinged at its upper end portion so that the U-shaped guide portion 25*a* of the thread take-up lever 25 can be guided by the paired thread guide members 106. Therefore, the paired thread guide members 106 can be made of such a material of a wire member at a low cost as can be easily worked, and little sliding resistance acts between the U-shaped guide portion 25*a* and the paired thread guide members 106 thereby to cause little sliding sound.

INDUSTRIAL APPLICABILITY

A sewing machine with a needle thread cassette, in which the needle thread cassette and a cassette mount of the sewing machine can be reduced in sized and which is small-sized and excellent in operability.

What is claimed is:

1. A sewing machine with a needle thread cassette, in which a needle thread cassette housing a thread bobbin is removably mounted in an arm, characterized:

by comprising a cassette mount disposed near a thread take-up lever travel region, in which a thread guard of a thread take-up lever reciprocally travels, for removably mounting said needle thread cassette;

in that said needle thread cassette includes a cassette case, and a thread bobbin retaining portion for retaining a thread bobbin disposed in said cassette case; and in that said needle thread cassette is mounted in said cassette mount such that at least one of the axial direction of the thread bobbin retained in said thread bobbin retaining portion and the direction to feed out the thread from said thread bobbin is made generally parallel to the reciprocal traveling direction of the thread guard of the thread take-up lever.

2. A sewing machine with a needle thread cassette as set forth in claim 1, characterized in that said cassette mount is disposed at the front face portion of the leading end of said arm.

3. A sewing machine with a needle thread cassette as set forth in claim 2, characterized in that the thread take-up lever travel region, in which the thread guard of the thread take-up lever reciprocally travels, is provided in said arm at the portion closer to the base side than said cassette mount.

4. A sewing machine with a needle thread cassette as set forth in claim 1, characterized: in that said cassette mount is formed to mount said needle thread cassette removably from above; and in that there is formed a grooved guide portion for guiding the needle thread cassette linearly when said needle thread cassette is mounted and removed.

5. A sewing machine with a needle thread cassette as set forth in claim 1, characterized in that the cassette case of said needle thread cassette is provided with color discriminating means for discriminating the thread color of the thread bobbin housed in the cassette case.

6. A sewing machine with a needle thread cassette as set forth in claim 1, characterized in that a recess deeper on a radially inner side than the outer circumference of said thread bobbin is formed in such a portion of the thread bobbin retaining portion for retaining said thread bobbin as corresponds to the lower end portion of said thread bobbin.

7. A sewing machine with a needle thread cassette as set forth in claim 1, characterized in that the cassette case of said needle thread cassette is provided on its outer face with a thread holder capable of retaining the end side portion of the thread extending from the needle thread cassette to the outside of the needle thread cassette.

8. A sewing machine with a needle thread cassette, in which a needle thread cassette housing a thread bobbin is removably mounted in an arm, characterized:

by comprising:

a cassette mount disposed on the front face of the leading end portion of said arm for removably mounting said needle thread cassette;

a thread take-up lever travel region disposed in said arm near said cassette mount and closer to the portion of the base side, for allowing the thread guard of the thread take-up lever to reciprocally travel therein; and a thread tension regulator disposed to protrude at the lower end side of said cassette mount;

in that said needle thread cassette includes a cassette case; and in that said cassette case includes:

a thread bobbin retaining portion for retaining said thread bobbin with a vertical axis;

a thread exit for feeding the thread fed out from said thread bobbin, to the outside of said cassette case;

a thread passage for guiding the thread fed out from said thread bobbin, to said thread exit;

a slit for protruding the thread guard of the thread take-up lever into the cassette case; and a notch for protruding the thread tension regulator into the cassette case.

9. A sewing machine with a needle thread cassette as set forth in claim 8, characterized: in that said thread tension regulator includes thread tension discs and a thread tension spring; and in that the needle thread of the needle thread cassette is engaged with the thread guard of the thread take-up lever, the thread tension discs and the thread tension spring in association with the action to mount said needle thread cassette in the cassette mount.

10. A sewing machine with a needle thread cassette as set forth in claim 8, characterized:

in that said thread passage is constructed to feed out the needle thread upward from the thread bobbin of said thread bobbin retaining portion and then to guide the fed needle thread to the thread exit of the cassette case;

in that said needle thread cassette is provided with a first clamp portion for applying a passing resistance to the needle thread upstream of the thread passage, and a second clamp portion for applying a passing resistance to the needle thread near the thread exit of the cassette case; and in that said first clamp portion applies the passing resistance to the needle thread to tense the needle thread between itself and the thread tension regulator no matter whether the needle thread cassette is mounted or not in the cassette mount.

11. A sewing machine with a needle thread cassette as set forth in claim 10, characterized in that before said needle thread cassette is completely mounted in the cassette mount, the passing resistance applied at the second clamp portion is made higher than the passing resistance applied at the first clamp portion.

12. A needle thread cassette to be removably mounted on the arm of a sewing machine, characterized:

by comprising:

a cassette case;

a thread bobbin;

a thread bobbin retaining portion disposed in said cassette case for retaining said thread bobbin in the cassette case; and a thread passage disposed in said cassette case for guiding the thread fed out from said thread bobbin, to said thread exit; and in that said thread bobbin or said thread passage is so arranged that when the needle thread cassette is mounted in the sewing machine, at least one of the axial direction of the thread bobbin retained in said thread bobbin retaining portion and the direction to feed out the thread from said thread bobbin is made generally parallel to the reciprocal traveling direction of the thread guard of the thread take-up lever.

13. A needle thread cassette as set forth in claim 12, characterized:

in that said cassette case further includes:

a slit for protruding the thread guard of the thread take-up lever into the cassette case; and a notch for protruding the thread tension regulator into the cassette case; and in that said cassette case is removably mounted in the vicinity of the thread take-up lever travel region, in which the thread guard of the thread take-up lever reciprocally travels.

14. A needle thread cassette as set forth in claim 12, characterized:

in that said thread passage feeds out the thread upward from the thread bobbin of said thread bobbin retaining portion and guides the fed thread into said thread exit;

in that said thread passage further includes:

a first clamp portion disposed in said cassette case for applying a passing resistance to the thread upstream of said thread passage; and a second clamp portion disposed in said cassette case for applying the passing resistance to the thread near said thread exit; and in that said first clamp portion applies the passing resistance to the needle thread to tense the needle thread between itself and the thread tension regulator no matter whether the needle thread cassette is mounted or not in the cassette mount.

15. A needle thread cassette as set forth in claim 14, characterized: in that before completely mounted in the sewing machine, the passing resistance applied at the second clamp portion is made higher than the passing resistance applied at the first clamp portion.

16. A needle thread cassette as set forth in claim 12, characterized by further comprising color discriminating means for discriminating the thread color of the thread bobbin housed in the cassette case.

17. A needle thread cassette as set forth in claim 12, characterized in that a recess deeper on a radially inner side than the outer circumference of said thread bobbin is formed in such a portion of the thread bobbin retaining portion for retaining said thread bobbin as corresponds to the lower end portion of said thread bobbin.

18. A sewing machine with a needle thread cassette as set forth in claim 12, characterized in that the cassette case of said needle thread cassette is provided on its outer face with a thread holder capable of retaining the end side portion of the thread extending from the needle thread cassette to the outside of the needle thread cassette.

* * * * *